US007684574B2

(12) United States Patent
Keele, Jr. et al.

(10) Patent No.: US 7,684,574 B2
(45) Date of Patent: Mar. 23, 2010

(54) REFLECTIVE LOUDSPEAKER ARRAY

(75) Inventors: D. Broadus Keele, Jr., Bloomington, IN (US); Douglas J. Button, Simi Valley, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 226 days.

(21) Appl. No.: 11/371,538

(22) Filed: Mar. 8, 2006

(65) Prior Publication Data

US 2006/0153407 A1 Jul. 13, 2006

Related U.S. Application Data

(63) Continuation-in-part of application No. 10/701,256, filed on Nov. 4, 2003.

(60) Provisional application No. 60/659,673, filed on Mar. 8, 2005, provisional application No. 60/473,513, filed on May 27, 2003.

(51) Int. Cl.
*H04R 25/00* (2006.01)
*H04R 9/06* (2006.01)

(52) U.S. Cl. ..... 381/160; 381/335; 381/336; 381/182

(58) Field of Classification Search ..... 381/335, 381/336, 337, 339, 350, 352, 160, 187, 189, 381/191, 199, 17–19, 307, 310, 182; 181/187, 181/189, 191, 199
See application file for complete search history.

(56) References Cited

U.S. PATENT DOCUMENTS 3,645,355 A 2/1972 Long ..... 181/31

(Continued)

FOREIGN PATENT DOCUMENTS

EP 0 386 846 9/1990

(Continued)

OTHER PUBLICATIONS

The Application of Broadband Constant Beamwidth Transducer (CBT) Theory to Loudspeaker Arrays, D.B. (Don) Keele, Jr., AES 109$^{th}$ Convention, Los Angeles, Sep. 22-25, 2000.

(Continued)

*Primary Examiner*—Vivian Chin
*Assistant Examiner*—George C Monikang
(74) *Attorney, Agent, or Firm*—Brinks Hofer Gilson and Lione

(57) ABSTRACT

A reflective loudspeaker array is cooperatively operable with an acoustically reflective planar surface to provide a constructive combination of direct and reflected sound waves that produces a uniform sound field. The uniform sound field provides a controlled sound field in the vertical and horizontal direction, and also provides uniformity from distances close to the reflective loudspeaker array to far way. The direct and reflected sound waves are advantageously and constructively combinable to generate a focused beamwidth of soundwaves. The reflective loudspeaker array includes a plurality of loudspeakers coupled to a surface of the reflective loudspeaker array. The surface may be formed to include at least one curve with a radius of curvature. The reflective loudspeaker array may be placed adjacent an acoustically reflective planar surface such that a frontal plane of a loudspeaker adjacently located closest to the acoustically reflective planar surface is aligned perpendicularly, and a frontal plane of a loudspeaker spaced away from the acoustically reflective planar surface is not aligned perpendicularly.

32 Claims, 23 Drawing Sheets

U.S. PATENT DOCUMENTS

| | | | | |
|---|---|---|---|---|
| 4,071,112 | A | 1/1978 | Keele, Jr. | 181/187 |
| 4,104,641 | A | 8/1978 | Unz | 343/844 |
| 4,174,019 | A | 11/1979 | Kramer | 181/159 |
| 4,187,926 | A | 2/1980 | Henricksen et al. | 181/192 |
| 4,237,340 | A | 12/1980 | Klipsch | 179/1 D |
| 4,280,585 | A | 7/1981 | Nakanishi | 181/147 |
| 4,289,929 | A | 9/1981 | Hathaway | 179/1 E |
| 4,308,932 | A | 1/1982 | Keele, Jr. | 181/187 |
| 4,344,504 | A | 8/1982 | Howze | 181/187 |
| 4,348,552 | A | 9/1982 | Siccone | 179/1 E |
| 4,387,270 | A | 6/1983 | Sakano et al. | 179/1 F |
| 4,391,346 | A | 7/1983 | Murakami et al. | 181/147 |
| 4,410,063 | A | 10/1983 | Yasue et al. | 181/147 |
| 4,437,540 | A | 3/1984 | Murakami et al. | 181/147 |
| 4,503,930 | A | 3/1985 | McDowell | 181/145 |
| 4,580,655 | A | 4/1986 | Keele, Jr. | 181/192 |
| 4,637,490 | A | 1/1987 | Oxner | 181/175 |
| 4,653,606 | A | 3/1987 | Flanagan | 181/145 |
| 4,654,835 | A | 3/1987 | Feintuch | 367/100 |
| 4,685,532 | A | 8/1987 | Gunness | 181/185 |
| 4,845,759 | A | 7/1989 | Danley | 381/97 |
| 4,940,108 | A | 7/1990 | Selby | 181/145 |
| 4,991,687 | A | 2/1991 | Oyaba et al. | 181/145 |
| 5,109,419 | A | 4/1992 | Griesinger | 381/63 |
| 5,164,549 | A | 11/1992 | Wolf | 181/147 |
| 5,526,325 | A | 6/1996 | Sullivan et al. | 367/138 |
| 5,590,214 | A | 12/1996 | Nakamura | 181/182 |
| 5,642,429 | A | 6/1997 | Janssen | 381/182 |
| 5,657,391 | A | 8/1997 | Jyosako | 381/1 |
| 5,742,693 | A | 4/1998 | Elko | |
| 5,802,190 | A | 9/1998 | Ferren | 381/182 |
| 5,809,153 | A * | 9/1998 | Aylward et al. | 381/337 |
| 6,016,353 | A | 1/2000 | Gunness | 381/342 |
| 6,070,461 | A | 6/2000 | Gjessing et al. | 73/170.15 |
| 6,112,847 | A * | 9/2000 | Lehman | 181/152 |
| 6,118,883 | A | 9/2000 | Rocha | 181/387 |
| 6,373,955 | B1 | 4/2002 | Hooley | 381/335 |
| 6,394,223 | B1 | 5/2002 | Lehman | |
| 6,556,687 | B1 * | 4/2003 | Manabe | 381/387 |
| 6,597,797 | B1 | 7/2003 | Betts | 381/336 |
| 6,603,862 | B1 | 8/2003 | Betts | 381/336 |
| 6,628,796 | B2 * | 9/2003 | Adamson | 381/342 |
| 6,833,656 | B2 | 12/2004 | Hooley et al. | 310/369 |
| 6,961,438 | B1 | 11/2005 | Fujita | 381/182 |
| 7,110,550 | B2 | 9/2006 | Motojima et al. | 381/27 |
| 7,298,853 | B2 * | 11/2007 | Norris et al. | 381/77 |
| 7,343,018 | B2 | 3/2008 | van der Werff | 381/80 |
| 2004/0240697 | A1 | 12/2004 | Keele, Jr. | |
| 2004/0247140 | A1 * | 12/2004 | Norris et al. | 381/77 |
| 2005/0025318 | A1 | 2/2005 | Sadaie et al. | |

FOREIGN PATENT DOCUMENTS

| | | | |
|---|---|---|---|
| EP | 1199907 | A2 | 4/2002 |
| EP | 1 422 969 | | 5/2004 |
| GB | 2 303 990 | A | 3/1997 |
| JP | 6-307107 | | 1/1994 |
| JP | 6-225379 | | 12/1994 |
| WO | WO 01/23104 | A2 | 4/2001 |
| WO | WO 2004/071129 | | 8/2004 |

OTHER PUBLICATIONS

Implementation of Straight-Line and Flat-Panel Constant Beamwidth Transducer (CBT) Loudspeaker Arrays Using Signal Delays, D.B. (Don) Keele, Jr. AES 113$^{th}$ Convention Oct. 5-8, 2002, Los Angeles, California USA.

The Full-Sphere Sound Field of Constant Beamwidth Transducer (CBT) Loudspeaker Line Arrays, D.B. (Don) Keele, Jr., AES 114$^{th}$ Convention Mar. 22-25, 2003, Amsterdam, The Netherlands.

New Approach to a Constant Beamwidth Transducer, Peter H. Rogers and A. L. Van Buren, J. Acoust. Soc. Am., 64(1), Jul. 1978.

Experimental Constant Beamwidth Transducer, A. L. Van Buren, L. Dwight Luker, M. D. Jevnager, and A. C. Tims, J. Acoust. Soc. Am. 73(6), Jun. 1983.

"What's So Sacred About Exponential Horns?" by D.B. Keele, Jr., May 1975.

"Design of Logarithmically Spaced Constant-Directivity Transducer Arrays", Manno Van Der Wal, Evert W. Start and Diemer De Vries, AES Journal of the Audio Engineering Society Audio/Acoustics/Applications, vol. 44, No. 6, Jun. 1996.

"Unbaffled Loudspeaker Column Arrays", John K. Hilliard, AES Journal of the Audio Engineering Society, Audio/Acoustics/Applications, vol. 18, No. 6, Dec. 1970.

"The Manta-Ray Horns", Clifford A. Henricksen and Mark S. Ureda, AES Journal of the Audio Engineering Society, Audio/Acoustics/Applications, vol. 26, No. 9, Sep. 1978.

Amar G. Bose, Prof. of EE M.I.T., "Sound Recording and Reproduction, Part One: Devices, Measurements, and Perception; Part Two: Spatial and Temporal Dimensions", Technology Review, vol. 75, No. 7, Jun. 1973.

* cited by examiner

REFLECTIVE LOUDSPEAKER ARRAY

PRIORITY CLAIM

This application claims the benefit of priority from U.S. Provisional Application No. 60/659,673, filed Mar. 8, 2005, which is incorporated by reference. In addition, this application is a continuation in part of pending U.S. patent application Ser. No. 10/701,256, filed Nov. 4, 2003, which claims the benefit of U.S. Provisional Application No. 60/473,513, filed May 27, 2003, both of which are also incorporated by reference.

BACKGROUND OF THE INVENTION

1. Technical Field

This invention relates generally to loudspeakers, and more particularly to a loudspeaker array configured to cooperatively operate with an acoustically reflective planar surface to provide a constant-beamwidth sound field.

2. Related Art

A loudspeaker enclosure may be a source for a sound field. For example, a typical loudspeaker enclosure may be used to generate a sound field for "live" sound reinforcement, for home entertainment, for car audio, for a discotheque, or the like. Generally, three-dimensional radiation patterns of sound fields generated by a loudspeaker vary with frequency. Such a sound field also may not be focused at the intended listeners, and spectral content of the sound field may vary with direction. In applications where a sound field is generated in an enclosed or a partially enclosed space, an unfocused sound field may cause constructive and destructive wave interference patterns, which may further distort the sound field at different locations.

A theoretically ideal loudspeaker, on the other hand, produces a sound field with a spectral content that does not vary with direction, and that has three-dimensional constant radiation patterns over a wide frequency range. For certain applications, such as use in an enclosed or partially enclosed space, it may be desirable to have a loudspeaker that has constant directivity in addition to constant radiation patterns over a wide frequency range. Constant directivity may also be desirable in an unenclosed space. A loudspeaker with radiation patterns that do not differ significantly with respect to frequency is referred to herein as a constant-directivity or a constant-beamwidth loudspeaker.

Various methods have been used in the sound industry to attempt to construct a constant-beamwidth loudspeaker that overcomes the above-mentioned problems. The use of horns, arrays and higher order sources have all been implemented. In sonar applications, constant-beamwidth transducers using spherical caps have been described in the literature. So far, none of these approaches have overcome the problems described above associated with typical loudspeakers. It would be desirable to provide a constant-beamwidth loudspeaker that produces a sound field with spectral content that does not vary significantly with direction and that has three-dimensional radiation patterns that are relatively consistent over a wide frequency range. In addition, it would be desirable to provide a constant-beamwidth loudspeaker that advantageously uses an acoustically reflective planar surface to minimize undesirable signal reflections that can detrimentally modify the frequency response and radiation pattern.

SUMMARY

The present invention includes a reflective loudspeaker array that is cooperatively operable with an acoustically reflective planar surface to optimize a frequency response and a radiation pattern of a sound field produced by the reflective loudspeaker array. The frequency response and radiation pattern are optimized by advantageously combining sound waves that are produced directly by the reflective loudspeaker array with reflected sound waves produced when the directly produced sound waves "bounce" off the acoustically reflective planar surface.

The reflective loudspeaker array includes a frame and five or more loudspeakers coupled with the frame. The frame may include a longitudinally extending frame surface having a radius of curvature of a predetermined angle in which the loudspeakers are disposed. The frame includes a first end having a base with a substantially flat surface and a second end. The loudspeakers may be positioned linearly along the surface of the frame so that one of the loudspeakers is positioned at the first end of the frame and one of the loudspeakers is positioned at the second end of the frame. The base may be positioned next to, and substantially in parallel with, an acoustically reflective planar surface, such as a floor, a wall, a ceiling or any other acoustically reflective boundary or acoustically reflective barrier.

The loudspeaker positioned at the first end of the frame includes a frontal plane that may be positioned substantially perpendicular with the acoustically reflective planar surface. The loudspeaker positioned at the second end of the frame also may include a frontal plane that forms an angle with the acoustically reflective planar surface that is less than ninety degrees. The reflective loudspeaker array also may include multiple rows and/or columns of loudspeakers in the frame. The frame may include a plurality of subframes that are moveable with respect to each other to adjust one or more radius of curvature of the frame, such as one or more vertical and/or horizontal radius of curvature.

The reflective loudspeaker array may provide audio signals to drive the loudspeakers and produce audible sounds in the form of a focused soundfield with a substantially constant beamwidth. The magnitude of the provided audio signals and/or the output sound pressure levels may be selectively reduced depending on the location of the loudspeakers in the reflective loudspeaker array. In one example, the loudspeaker at the first end of the frame may be provided an audio signal that is a maximum magnitude of any audio signal provided to the reflective loudspeaker array or maximum output sound pressure level. The remaining loudspeakers may be provided signals with stepwise reduced magnitudes toward the second end of the reflective loudspeaker array and/or output corresponding stepwise reduced sound pressure levels. The loudspeakers also may be grouped in sub arrays. A sub array at the first end of the frame, nearest the acoustically reflective planar surface, may receive the maximum magnitude of audio signals and the remaining sub arrays may receive a step wise reduced magnitude of the audio signal depending on the location of the sub arrays. The sub array at the second end of the reflective loudspeaker array may receive the audio signal with the lowest relative magnitude.

During operation using the acoustically reflective planar surface, direct audible sound generated by the reflective loudspeaker array may produce a perceived mirror image reflective loudspeaker array that is axially aligned with the reflective loudspeaker array, and perceived to be positioned on the opposite side of the acoustically reflective planar surface that the reflective loudspeaker array is near. The symmetric combination of the reflective loudspeaker array and the mirror image reflective loudspeaker array may form a virtual composite array. The virtual composite array generates an acoustic image that is perceived acoustically and visually to increase the height of the reflective loudspeaker array. Consequently, the perceived number of loudspeakers, the sensitivity, and the sound pressure level capability of the reflective loudspeaker array may be increased. In addition, the virtual composite array may extending the operating frequency bandwidth an octave lower and minimize perceived variations in a near field sound pressure level and a far field sound pressure level, as a listener moves from a position close to the reflective loudspeaker array to a position farther away.

The acoustic image is produced from audio signals provided to drive the loudspeakers to generate direct audio sound waves. A portion of the direct audio sound waves reflect off the acoustically reflective planar surface as reflected audio sound waves. The direct audio sound waves are generated to be constructively combinable with the reflected audio sound waves to produce the acoustic image that is perceived to be about double the height of the reflective loudspeaker array.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
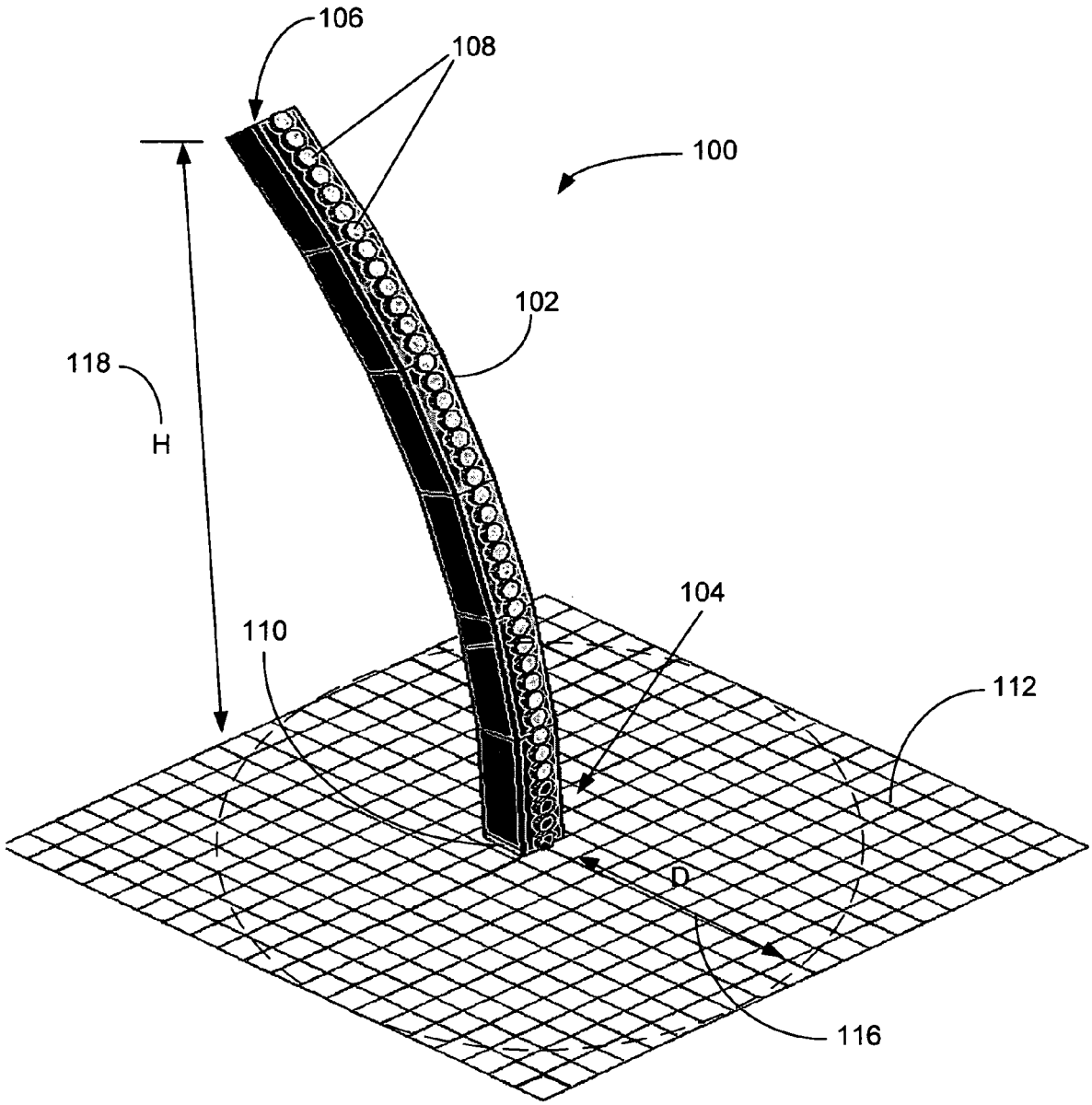
FIG. 1 is a perspective view of an example reflective loudspeaker array positioned adjacent an acoustically reflective planar surface.

The present invention includes a reflective loudspeaker array that can be operated when aligned with an acoustically reflective planar surface. The reflective loudspeaker array includes an array of loudspeakers that are intended to operate to produce sound waves near or very close to a sound reflecting surface or boundary, such as a table, a stage, a floor, a wall, a ceiling, or any other form of surface defining a plane. The reflective loudspeaker array may be operated as a Constant Beamwidth Transducer (CBT) loudspeaker line array that takes advantage of an acoustically reflective planar surface to increase the perceived acoustic size of the reflective loudspeaker array due to the acoustic reflection of the sound waves by the acoustically reflective planar surface.

Due to the combination of the direct sound waves, and the organized and controlled reflectivity of the reflected sound waves, the reflective loudspeaker array may provide a number of strong performance and operational advantages. When placed in proximity to an acoustically reflective planar surface the performance and operational advantages include: elimination of undesirable floor reflections; a perceived increase of the effective height of the reflective loudspeaker array; an increase of the sensitivity of the reflective loudspeaker array; an increase of the maximum sound pressure level (SPL) capability; a decrease of near-far variation of sound pressure level (SPL); and an operating bandwidth that may be extended down by at least about an octave.

The term "constant-beamwidth transducer" is used to describe how the loudspeakers in the reflective loudspeaker are disposed and driven. In general, the transducers are omni-directional type loudspeakers that are organized and focused into a concentrated beam of soundwaves by the cooperative operation of the loudspeakers included in reflective loudspeaker array with the acoustically reflective planar surface. To provide a better understanding, a general discussion of a constant beamwidth transducer is provided.

Constant-Beamwidth Transducer Theory

An ideal transducer in the form of a rigid circular spherical cap of arbitrary half angle whose normal surface velocity (pressure) is attenuated according to a Legendre function may function as an ideal constant-beamwidth transducer. The Legendre attenuation may be independent of frequency. Such an ideal transducer may produce a broadband, symmetrical, directional acoustic field. The acoustic field may have a beam pattern and a directivity that are essentially independent of frequency over all frequencies above a determined cut-off frequency and that change very little as a function of distance from the ideal transducer. Such an ideal transducer may cover an arbitrary coverage angle with a constant-beamwidth that extends over a virtually unlimited operating bandwidth.

If a radial velocity or, equivalently, a sound pressure level on the outer surface of a rigid sphere conforms to:

$$u(\theta) = \begin{cases} P_v(\cos\theta) & \text{for } \theta \le \theta_0 \\ 0 & \text{for } \theta > \theta_0 \end{cases} \quad \text{(Equation 1)}$$

where $\mu(\theta)$=radial velocity distribution $\theta$=elevation angle in spherical coordinates, ($\theta$=0 is center of circular spherical cap)

$\theta_0$=half angle of spherical cap $P_v(x)$=Legendre function of order $v(v>0)$ of argument x, then an approximation of a far-field pressure pattern, above a determined cutoff frequency (which depends on the size of the sphere and the wavelength), will be:

$$p(\theta) = \begin{cases} P_v\cos(\theta) & \text{for } \theta \le \theta_0 \\ 0 & \text{for } \theta > \theta_0 \end{cases} \quad \text{(Equation 2)}$$

where $p(\theta)$ = radial pressure distribution

The Legendre function $P_v(\cos\theta)$ may be equal to one at $\theta$=0, and may have a first zero at angle $\theta=\theta_0$, the half angle of the spherical cap. The Legendre function order (v) may be chosen so that the first zero of the Legendre function occurs at the half angle of the spherical cap. The far-field sound pressure level pattern may be essentially equal to the sound pressure level on the surface of the spherical cap.

Arguably an ideal constant-beamwidth transducer would be in the form of an entire circular sphere, not merely a spherical cap. The surface pressure and velocity would be nearly zero over a large inactive portion of the outer surface of such a sphere, however. Therefore, the part of the sphere outside of a spherical cap region can be removed without significantly changing acoustic radiation patterns. In other words, a spherical cap may have a nearly ideal constant-beamwidth behavior even though the rest of the sphere is missing.

The advantages of a constant-beamwidth transducer above the cutoff frequency may include an essentially constant beam pattern, very low side lobes, and a pressure distribution at all distances out to the far-field that is approximately equal to the surface distribution. Because both the surface velocity and surface pressure have the same dependence on $\theta$, the local specific acoustic impedance may be independent of $\theta$. Thus, the entire transducer may be uniformly loaded.

A simplified four-term series approximation to the Legendre attenuation of Equation 1 is:

$$U(x) \approx \begin{cases} 1 + 0.66x - 1.8x^2 + 0.743x^3 & \text{for } x \le 1 \\ 0 & \text{for } x > 1 \end{cases} \quad \text{(Equation 3)}$$

where $$x = \text{normalized angle}\left(\frac{\theta}{\theta_0}\right)$$

Locations "outside" an active spherical cap region (where attenuation is less than 13.5 dB) may be removed without significantly changing acoustic radiation patterns. Therefore, the simplified four-term series approximation of Equation 3 can be recalculated by truncating the attenuation where it rises above 13.5 dB. A revised four-term series approximation, where 13.5 dB attenuation occurs where the normalized angle x=1 may be stated as:

$$U_{trunc}(x) \approx \begin{cases} 1 + 0.0561x - 1.3017x^2 + 0.457x^3 & \text{for } x \le 1 \\ 0 & \text{for } x > 1 \end{cases} \quad \text{(Equation 4)}$$

where $$x = \text{normalized angle}\left(\frac{\theta}{\theta_0}\right)$$

Equation 4 may be derived from Equation 3 by substituting x=0.8504 ẋ. For example, the first, second and third order terms may be derived as follows:

First: $+0.066*(0.8504)^1=+0.0561$

Second: $-1.8*(0.8504)^2=-1.3017$

Third: $+0.743*(0.8504)^3=+0.457$

The revised four-term series approximation of Equation 4 "expands" the attenuation values over the active region so that the 13.5 dB attenuation points may occurs at x=1.

Constructing a constant-beamwidth transducer in the form of a rigid circular spherical cap producing varying sound pressure levels may not be practical for loudspeaker applications. It is practical, however, to simulate such a rigid circular spherical cap with an array of discrete speaker drivers (loudspeakers) in a loudspeaker enclosure. The speaker drivers may be arranged to form a circular or toroidal cap or wedge. Methods for designing and constructing such an array of loudspeakers, referred to herein as a "loudspeaker array," or simply an "array," are described in detail later.

As used here, the terms "attenuation," "attenuate," and "attenuated" refer generally to a relative sound pressure levels, or relative electrical signal levels. For example, for an array of speaker drivers, the speaker driver or drivers producing the highest sound pressure level are said to be "attenuated" to 0 dB, and sound pressure levels generated by the remaining speaker drivers are indicated relatively. Likewise, where more than one electrical signal is present, the electrical signal having the highest level is said to be "attenuated" to 0 dB, and the levels of the remaining electrical signals are indicated relatively.

For speaker arrays, which comprise discrete speaker drivers, an upper-operational frequency limitation (upper-operational frequency) exists that has a wave-length approximately equal to the center-to-center spacing of the speaker array. At frequencies above the upper-operational frequency, the constant-beamwidth behavior of the speaker array may deteriorate.

Because the speaker drivers of the speaker array are discrete, the development of off-axis lobes may cause a sonic beam radiated by the speaker array to become uncontrollably wide above the upper-operational frequency. The response may drop abruptly above the upper-operational frequency, because the speaker array's energy is spread out over a much wider angle. The attenuation above the upper-operational frequency may be essentially chaotic. To help compensate for this attenuation, the individual speaker drivers of the speaker array may be selected to individually provide a measure of narrow coverage. This may allow the speaker array to approximate its lower-frequency behavior at higher frequencies.

The center-to-center spacing of the speaker array's speaker drivers may determine the upper-operational frequency. The size of the speaker array and the speaker array's angular coverage, however, may determine the lower-operational frequency for constant-beamwidth operation. The relationship between the size of the speaker array, the angular coverage of the sonic beam produced by the array, and the lower-operational frequency is approximately similar to the corresponding relationships for constant directivity horns:

$$X = \frac{K}{\theta f_i} \qquad \text{(Equation 5)}$$

where

X=horn mouth width (or height)

θ=coverage angle of horn (−6 dB point)

$f_i$=frequency down to which coverage angle is maintained

K=constant ($2.5\times10^4$ meters-degs-Hz, or $1\times10^6$ inches-degs-Hz) that may change in different loudspeaker designs.

For example, a reflective loudspeaker array providing 65 degrees of constant-beamwidth coverage down to 1.15 kHz should be about 100 mm high. With a reflective loudspeaker array, K may be about $7.6\times10^3$ meters-degs-Hz, or $3.0\times10^5$ inches-degs-Hz. The first example reflective loudspeaker array described with reference to FIG. 1 is designed to provide about 34 degrees of constant-beamwidth coverage down to approximately 225 Hz (lower-operational frequency), and is therefore about 1.0 m high. The relationships between the above mathematical models and physical dimensions of the reflective loudspeaker array are explained in greater detail later.

FIG. 1 is a perspective view of one example of a reflective loudspeaker array 100. The loudspeaker array 100 includes a frame 102 having a first end 104 and a second end 106. The frame 102 may be a housing, a strut, a track, a plate, or any other structure that maintains the position of a plurality of loudspeakers 108 with respect to each other. The frame 102 of this example is formed with a curve of a constant radius of curvature and a predetermined length that results in an arc angle ($\theta_0$) of about 45 degrees. In other examples, the frame 102 may be formed to include two or more curves, each with a constant radius of curvature that may or may not be the same.

The first end 104 may include a base 110. The base 110 is configured to be positioned adjacent to, or contiguous with an acoustically reflective planar surface 112. The base 110 may have a substantially flat surface that is contiguously alignable in parallel with the acoustically reflective planar surface 112. In one example, the base 110 may provide a stand upon which the remainder of the reflective loudspeaker array 100 may be vertically and horizontally supported and maintained in position with respect to the acoustically reflective planar surface 112. The second end 106 may be maintained in free air spaced away from the acoustically reflective planar surface 112.

The loudspeakers 108 may be any form of transducer or speaker driver capable of receiving an electrical signal and converting the electrical signal to a corresponding acoustical sound. In one example, the loudspeakers 108 may be miniature wide-band speaker drivers, such as 32 mm full-range (200 Hz to 20 kHz) speaker drivers used in Harman Sound Sticks, or any of similar speaker drivers used in laptop computers, flat panel monitors, desktop speaker enclosures, and the like. The loudspeakers 108 may each include a sound emitting surface that forms a frontal plane. The sound emitting surface may include a movable surface having an area, and the areas of the movable surfaces of the loudspeakers 108 may be substantially equal in size. The high-frequency beaming of such loudspeakers 108 may allow the reflective loudspeaker array 100 to maintain a nearly constant beam-width at frequencies up to a determined frequency, such as up to 16 kHz, even though according to a center-to-center high frequency operating limit that is discussed later, the upper-operational frequency should be approximately 8 kHz.

The acoustically reflective planar surface 112 may be in the shape of a square, a circle, a triangle, an ellipse, or any other shape having a substantially flat planar surface that the reflective loudspeaker array 100 may be aligned with. In one example, the acoustically reflective planar surface 112 may create a plane that is almost infinite from the perspective of the reflective loudspeaker array 100, such as for example the floor, wall, or ceiling of a large room. In other examples, the acoustically reflective planar surface 112 may be smaller, such as, for example, a tabletop.

When the acoustically reflective planar surface 112 provides less than a substantially infinite planar surface, the loudspeaker array 100 may be concentrically aligned with a central axis of the acoustically reflective planar surface 112 that is perpendicular with the planar surface, so that the planar surface of the acoustically reflective planar surface 112 extends away from reflective loudspeaker array 100 about an equal distance in all directions. In general, to maximize the beneficial effect of the reflected sound waves, the acoustically reflective planar surface 112 should be as large as possible. However, in one example, the acoustically reflective planar surface 112 may have a diameter (D) 116 that is no smaller than a height (H) 118 of the reflective loudspeaker array 100. In other examples, where the diameter (D) 116 is larger than the height (H) 118, the reflective loudspeaker array 100 may offset from the central axis of the acoustically reflective planar surface 112.

In FIG. 1, there are 40 loudspeakers 108 linearly disposed in the frame 102 concentric with a common central axis of the frame 102 to form a single array. In other examples, any configuration of loudspeakers 108 that includes five or more loudspeakers 108 in one or more arrays may be used.

With reference to Equations 1 through 4, a sound pressure pattern distribution in a far sound field produced by the reflective loudspeaker array 100 is approximately equal to a sound pressure pattern distribution in a near sound field. In general, a far sound field is any distance from the reflective loudspeaker array 100 that is greater than the height (H) 118 of the reflective loudspeaker array 100, and the near sound field is any distance from the reflective loudspeaker array 100 that is equal to or less than the height (H) 118 of the reflective loudspeaker array 100. A vertical coverage area, or a vertical beamwidth of the reflective loudspeaker array 100, is defined as a portion of a sonic beam produced by a constant-beamwidth transducer where sound pressure levels are greater than −6 dB. With the reflective loudspeaker array 100, the angle of curvature of the frame 102 may dictate the vertical coverage over the operational frequency range. In addition, a radius of curvature of the reflective loudspeaker array 100 may dictate the overall height (H) 118 of the reflective loudspeaker array 100.

Figure 2:
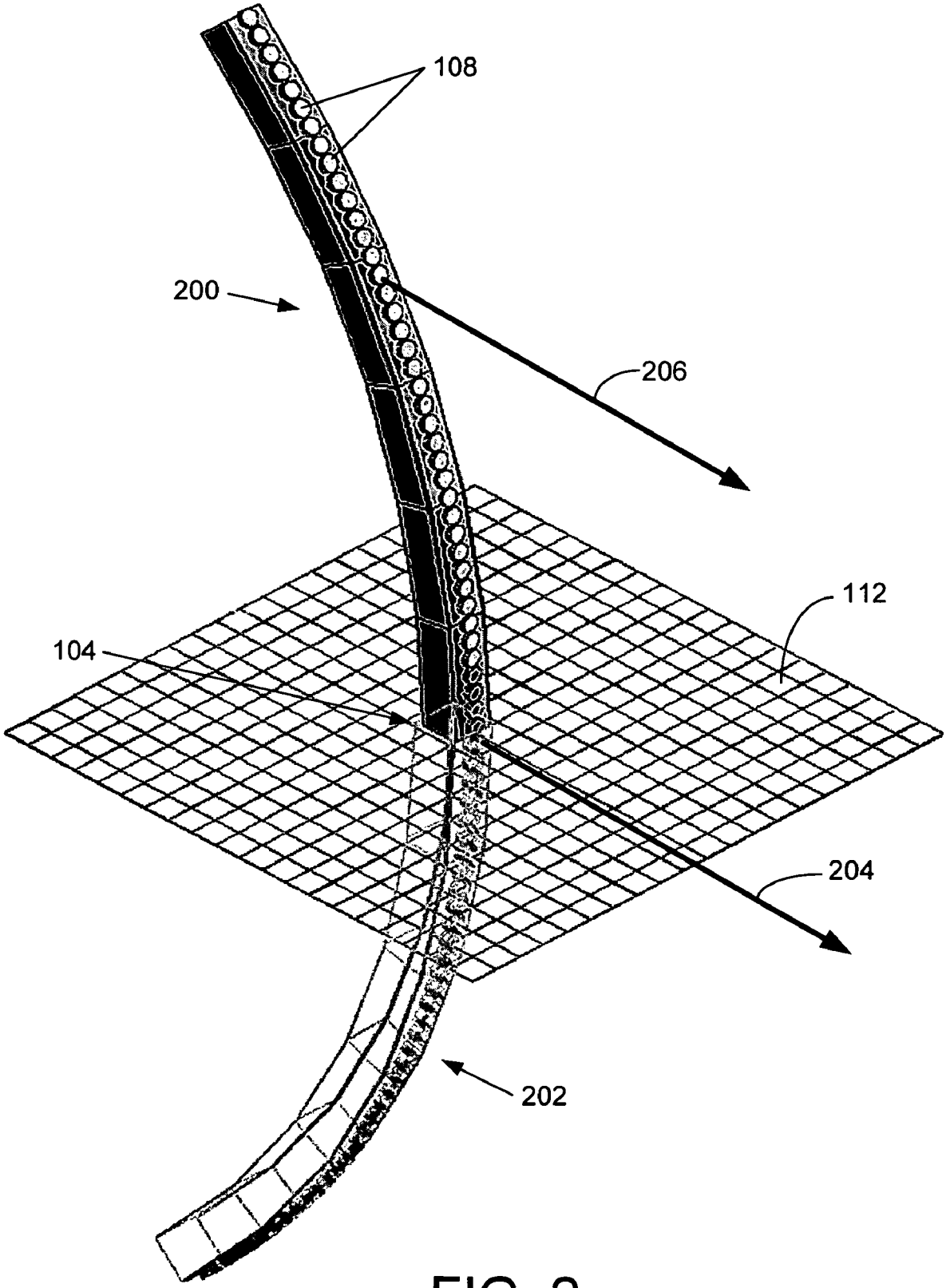
FIG. 2 is another perspective view of the reflective loudspeaker array of FIG. 1 illustrating a mirror image reflective loudspeaker array.

FIG. 2 is another perspective view of an example reflective loudspeaker array 200 that includes a representation of a mirror image reflective loudspeaker array 202. The mirror image reflective loudspeaker array 202 is a mirror image of the reflective loudspeaker array 200 and illustrates the effect of the sound waves reflected from the acoustically reflective planar surface 112. In FIG. 2, the combination of the reflective loudspeaker array 200 and the corresponding mirror image reflective loudspeaker array 202 forms a perceived single composite virtual loudspeaker array that is about double the height of the reflective loudspeaker array 200 and has double the number of loudspeakers 108. The first end 104 of the reflective loudspeaker array 200 and one end of the image reflective loudspeaker array 202 may be contiguously positioned to form a vertical stack that is the virtual composite loudspeaker array.

The virtual composite loudspeaker array is similar in overall appearance to the freestanding loudspeaker array included in the loudspeaker system described in U.S. patent application Ser. No. 10/701,256 filed on Nov. 4, 2003, which is incorporated by reference. Accordingly, the reflective loudspeaker array 200 provides many similar characteristics to the freestanding loudspeaker array with significant additional benefits due to the advantageous use of the acoustically reflective planar surface 112. The benefits include both performance and operational advantages.

The reflective loudspeaker array 200 is designed to operate in conjunction with the acoustically reflective planar surface 112 (such as the floor, wall, or ceiling). Thus, the acoustic reflections from the acoustically reflective planar surface 112 enhance the acoustic output of the reflective loudspeaker array 200 to generate an acoustic image. The acoustic image is generated by the combination of the direct sound waves generated with the reflective loudspeaker array 200 and the reflected sound waves provided with the mirror image reflective loudspeaker array 202. Accordingly, the reflected sound waves desirably enhance the direct sound waves and thus the operation of the reflective loudspeaker array 200. In addition, the acoustically reflective planar surface 112 effectively doubles the height of the reflective loudspeaker array 200 because of the acoustic reflection provided by the acoustically reflective planar surface 112.

In general, the acoustically reflective planar surface 112 may be thought of as affecting sound waves similarly to the way a mirror operates on light waves. Thus, the reflected sound waves are a mirror image of the direct sound waves that, when constructively combined with the direct sound waves, produce the acoustic image. The resulting virtual composite loudspeaker array also provides increases sensitivity. The sensitivity of a loudspeaker is defined as the sound level the speaker generates at a given distance for a specific input power or applied voltage. The rated sound pressure level (SPL) at one meter for an input power of one Watt or an applied voltage of 2.83 Vrms (one Watt in an eight-ohm load) are example sensitivity measurement parameters.

The sensitivity of reflective loudspeaker array 200 may be effectively doubled, as compared to a free-standing array of the same height, because the planar surface serves to effectively double the height of the reflective loudspeaker array 200 and effectively double the number of loudspeakers 108 disposed in the reflective loudspeaker array 200. The height and number of loudspeakers 108 are effectively increased due to the combination of the reflected sound waves and the direct sound waves. Cooperative operation of the acoustically reflective planar surface 112 provides a sound reflection that may raise the SPL and sensitivity of the reflective loudspeaker array 200 by about 6 dB. In addition, the maximum Sound Pressure Level (SPL) capability of the reflective loudspeaker array 200 may be increased. In other words, the reflective loudspeaker array 200 may be operated to play about 6-dB louder than a free-standing array of the same height because the reflections from the acoustically reflective planar surface 112 may essentially double the sound pressure level.

The reflective loudspeaker array 200 in cooperative operation with the acoustically reflective planar surface 112 also may minimize near-far variation in SPL. When the reflective loudspeaker array 200 is placed on an acoustically reflected surface that is a floor, listeners are typically positioned to listen above a main axis 204 of the reflective loudspeaker array 200. The main axis 204 of the reflective loudspeaker array 200 is essentially at, or parallel with, the acoustically reflective planar surface 112. However, due to the vertical coverage of the reflective loudspeaker array 200 being sufficiently uniform, listening above the main axis 204 is not a detriment.

With a standard loudspeaker, as a listener gets closer to and further from the loudspeaker, the loudspeaker gets louder and softer, respectively. However, if the reflective loudspeaker array 200 is listened to by a listener along a listening axis 206 offset from the main axis 204, these variations in SPL are reduced. This effect takes advantage of off-axis uniformity of the coverage of the reflective loudspeaker array 200, which attenuates rapidly for increasing off-axis listening locations. Along a listening axis, such as listening axis 206, the SPL variations may be reduced because as the listener approaches the reflective loudspeaker array 200, he/she is farther off the main axis 204 of the reflective loudspeaker array 200. Conversely, as the listener retreats from the reflective loudspeaker array 200, he/she is closer to the main axis 204 of the reflective loudspeaker array 200. As proven through prototype testing described later, listening heights near the actual height of the reflective loudspeaker array 200 may greatly reduce or nearly nullify near-far variations of the SPL. At this height, the SPL hardly varies from locations near the reflective loudspeaker array 200, such as within 1 meter, to locations far from the reflective loudspeaker array 200, such as 3 to 7 meters away.

The cooperative operation of the reflective loudspeaker array 200 with the acoustically reflective planar surface 112 may also extend the operating bandwidth of the reflective loudspeaker array 200 downward by as much as an octave. The vertical beamwidth of the reflective loudspeaker array 200 may be controlled down to a frequency that is determined by the size (height) and arc angle ($\theta_0$) of the reflective loudspeaker array 200. The size and angular coverage of the reflective loudspeaker array 200 may be in direct proportion. For example, if the height of a reflective loudspeaker array 200 is doubled and its arc angle ($\theta_0$) remains the same, the reflective loudspeaker array 200 may control its vertical coverage an octave lower (×0.5) in frequency. Alternatively, if the height of a reflective loudspeaker array 200 remains the same, but its angular coverage is doubled, the reflective loudspeaker array 200 also may control vertical coverage an octave lower in frequency. Since the angular coverage of the reflective loudspeaker array 200 is defined as its coverage angle above the acoustical reflective planar surface 112, the operating frequency of the reflective loudspeaker array 200 effectively drops by about two octaves (×0.25) as compared to a free-standing array. This is because the perceived height of the reflective loudspeaker array 200 has doubled and its coverage angle has halved, as compared to a free-standing array due to the combination of the direct sound waves and the reflected sound waves.

Figure 3:
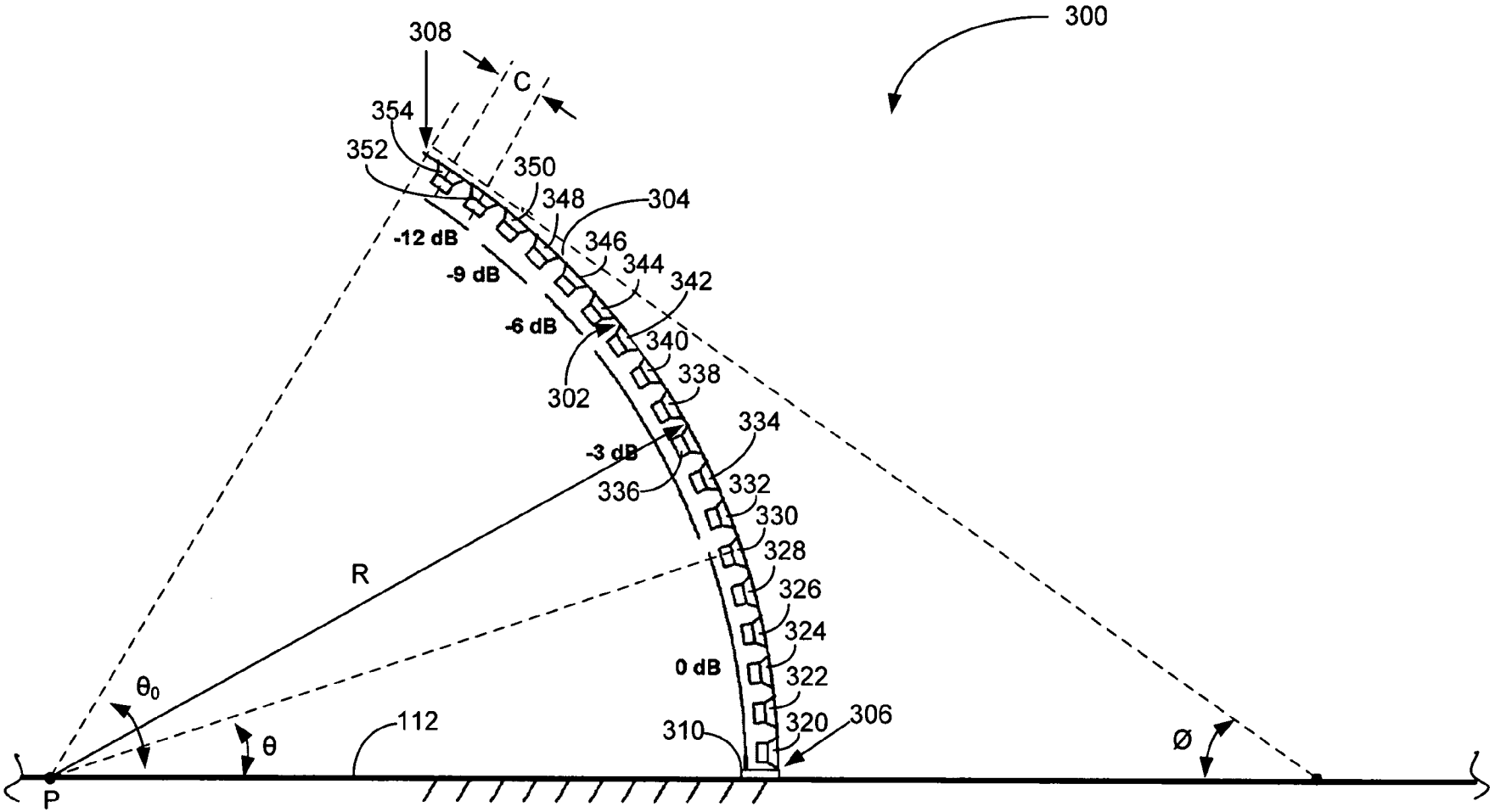
FIG. 3 is a side view of an example reflective loudspeaker array.

FIG. 3 is a side view of another example reflective loudspeaker array 300 that includes a frame 302 with a plurality of loudspeakers 108 (identified as loudspeakers 320-354) disposed on a surface 304. In FIG. 3, there are eighteen loudspeakers illustrated. In other examples, other quantities of loudspeakers, such as fifty one loudspeakers, or as few as five loudspeakers may be included in the reflective loudspeaker array 300. The frame 302 longitudinally extends from a first end 306 to a second end 308. A base 310 having a substantially flat surface may be included at the first end 306 so that the reflective loudspeaker array 300 may be positioned adjacent the acoustically reflective planar surface 112 with the surface of the base 310 disposed substantially parallel with the acoustically reflective planar surface 112.

The surface 304 of the frame 302 may have a constant curvature radius (R) of, for example, 1.0 m over an arc angle ($\theta_0$), for example, of 60°. As previously discussed, the radius of curvature (R) may dictate the vertical height of the reflective loudspeaker array 300. The arc angle ($\theta_0$), on the other hand may dictate the vertical coverage angle of the acoustical image generated by the reflective loudspeaker array 300. In general, the vertical beamwidth of the sound field of the reflective loudspeaker array 300 may be about three-fourths of the arc angle ($\theta_0$). Thus, in the example of FIG. 3, if the arc angle ($\theta$) is 60°, the vertical coverage angle of the acoustical image produced by the combination of the direct and reflected sound waves is about 45°.

A centerline of each of the loudspeakers 320-354 may also form a loudspeaker angle ($\theta$) with respect to the acoustically reflective planar surface 112. For example, in FIG. 3, the loudspeaker 330 forms a loudspeaker angle ($\theta$) with the acoustically reflective planar surface 112. Each of the other loudspeakers 320-354 may similarly form a loudspeaker angle ($\theta$) with the acoustically reflective planar surface. Example loudspeaker angles are provided in TABLE 1, which is discussed later.

The center-to-center spacing (C) between the loudspeakers 108 may be a predetermined distance based on the size of the loudspeakers 108 and the highest frequency audio signals that will drive the reflective loudspeaker array 300. Accordingly, the high frequency operating limit of the reflective loudspeaker array 300 may be dictated by the spacing of the loudspeakers 108. The center-to-center spacing may be uniform and/or non-uniform. In one example, the center-to-center spacing is uniform and is less than or equal to one half wavelength of the highest frequency signal that will drive the loudspeakers 320-354. For example, if the highest frequency the loudspeakers will be driven with is 10 kHz, then the spacing may be 17.25 mm assuming a speed of sound of 345 m/s at 20 degrees Celsius and standard pressure.

Each of the loudspeakers 320-354 may be coupled to and/or mounted in the surface 304 of the frame 302. A sound emitting surface of each of the loudspeakers 320-354 may form a frontal plane that is substantially parallel with the surface 304 in the vicinity where the respective loudspeaker 320-354 is positioned. Due to the relatively small diameter of the loudspeakers 320-354, although the surface 304 is curved, the frontal plane of the loudspeakers are substantially parallel with the surface 304 that is in the vicinity of each of the loudspeakers 320-354. In FIG. 3, the loudspeakers 320-354 that are disposed adjacently, such as 320 and 322, are substantially parallel. However, the loudspeakers 320-354 that are separated on the surface 304, such as 320 and 334, are not substantially in parallel due to the constant angle of curvature of the surface 304 in which the loudspeakers 320-354 are disposed. A first one of the loudspeakers 320 that is positioned proximate the first end 306 may have a frontal plane that is substantially perpendicular with the acoustically reflective planar surface 112. A second of the loudspeakers 354 may be positioned proximate the second end 308 such that a frontal plane of the second loudspeaker 354 forms an angle (Ø) with respect to the acoustically reflective planar surface 112.

In one example, the angle (Ø) may be less than ninety degrees, such as in FIG. 3, where the angle (Ø) is about thirty-five degrees. In another example, such as when the acoustically reflective planar surface 112 is a ceiling, the first end 306 and the second end 308 both may be positioned contiguous with the acoustically reflective planar surface 112 such that the frame 302 of the reflective loudspeaker array 300 generally forms a semi-circle. In this example, the angle (Ø) of the frontal plane of the second loudspeaker 354 proximate the second end 308 may be normal to the acoustically reflective planar surface 112 similar to the first loudspeaker 320 proximate the first end 306. In addition, in this example, the arc angle ($\theta_0$) would be one hundred eighty degrees.

In an alternative example, the reflective loudspeaker array 300 may be formed with a frame 302 that is normal with respect to the acoustically reflective planar surface 112. In other words, the frame 302 may be formed linearly, or straight, so that the entire frame is perpendicular with respect to the acoustically reflective planar surface 112. Thus, the surface 304 may also be normal with respect to the acoustically reflective surface 112. In this example, in order to achieve the positive combination of the direct sound waves and the reflected sound waves, delay may be introduced to the audio signals driving the loudspeakers 108 to simulate a radius of curvature (R). The audio signal provided to the loudspeaker 306 nearest the acoustically reflective planar surface 112 may have no delay. The audio signals provided to the remaining loudspeakers 308-354 may increase in a stepwise or continuously decreasing fashion toward the second end 308 so that the audio signal driving the loudspeaker 354 is subject to the maximum delay. The delay may be stepwise or continuously increased uniformly or non-uniformly. It is to be noted that the constructive combination of the direct sound waves and the reflected sound waves to create an acoustical image is maximized when a radius of curvature is present. Thus, a frame that is normal to an acoustically reflective planar surface 112 will not produce the virtual composite array and corresponding desired acoustical image due to interference of the direct and reflected sound waves.

As previously discussed, each of the loudspeakers 320-354 may be selectively attenuated with Legendre shading. Using Equation 4, attenuation values for the loudspeakers 320-354 may be calculated. Alternatively, Equation 1 or Equation 3 also may be used to calculate attenuation values for the loudspeakers 320-354. In one example, stepped or quantized attenuation values may be used. For example, using Equation 4 as the basis for quantized attenuation values yields:

$$U_{stepped}(x) = \begin{cases} 1 & \text{for } 0 \geq x < 0.4026 \\ 0.7071 & \text{for } 0.4026 \geq x < 0.6654 \\ 0.5 & \text{for } 0.6654 \geq x < 0.8209 \\ 0.3536 & \text{for } 0.8209 \geq x < 0.9261 \\ 0.25 & \text{for } 0.9261 \geq x \leq 1 \\ 0 & \text{for } x > 1 \end{cases} \quad \text{(Equation 6)}$$

where $$x = \text{normalized angle}\left(\frac{\theta}{\theta_0}\right)$$

In Equation 6, the numerical ranges may be the boundaries where values of x in Equation 4 transition from one quantization level to the next. For example, where x=0.4026, the attenuation level may transition from 0 dB to 3 dB. The quantized attenuation values used in this example are approximately to the nearest 3 dB level, so that attenuation approximations start at 0 dB (no attenuation), and drop by multiples of 3 dB. Other quantization resolutions or no quantization at all, may also be used. TABLE 1 illustrates an example of an attenuation value U(x) calculated using Equation 3, a truncated attenuation value $U_{trunc}(x)$ calculated using Equation 4, the truncated attenuation value in decibels, and a quantized attenuation value calculated using Equation 6 for each of the loudspeakers 320-354 in the reflective loudspeaker array 300.

TABLE 1

| Speaker driver | Angle (θ) | Normalized Angle $x = \theta/\theta_0$ | Attenuation Value U(x) | Truncated Attenuation Value $U_{trunc}(x)$ | Truncated Attenuation Value in dB | Quantized Attenuation Value in dB |
|---|---|---|---|---|---|---|
| 320 | 1.67 | 0.03 | 1.000 | 1.000 | 0.0 | 0 |
| 322 | 5.00 | 0.08 | 0.993 | 0.996 | 0.0 | 0 |
| 324 | 8.33 | 0.14 | 0.976 | 0.984 | −0.1 | 0 |
| 326 | 11.67 | 0.19 | 0.950 | 0.965 | −0.3 | 0 |
| 328 | 15.00 | 0.25 | 0.915 | 0.940 | −0.5 | 0 |
| 330 | 18.33 | 0.31 | 0.873 | 0.909 | −0.8 | 0 |
| 332 | 21.67 | 0.36 | 0.824 | 0.873 | −1.2 | −3 |
| 334 | 25.00 | 0.42 | 0.768 | 0.832 | −1.6 | −3 |
| 336 | 28.33 | 0.47 | 0.707 | 0.786 | −2.1 | −3 |
| 338 | 31.67 | 0.53 | 0.641 | 0.736 | −2.7 | −3 |
| 340 | 35.00 | 0.58 | 0.572 | 0.682 | −3.3 | −3 |
| 342 | 38.33 | 0.64 | 0.499 | 0.626 | −4.1 | −3 |
| 344 | 41.67 | 0.69 | 0.424 | 0.566 | −4.9 | −6 |
| 346 | 45.00 | 0.75 | 0.347 | 0.505 | −5.9 | −6 |
| 348 | 48.33 | 0.81 | 0.269 | 0.441 | −7.1 | −9 |
| 350 | 51.67 | 0.86 | 0.191 | 0.377 | −8.5 | −9 |
| 352 | 55.00 | 0.92 | 0.113 | 0.311 | −10.1 | −12 |
| 354 | 58.33 | 0.97 | 0.037 | 0.245 | −12.2 | −12 |

As can be seen in TABLE 1 and FIG. 3, with the quantization values chosen for this example, the loudspeakers 320-354 may be divided into sub-arrays having equal quantized attenuation values. In one example, there are five sub-arrays. A first sub-array may comprise loudspeakers 320-330, each of which has a quantized attenuation value of 0 dB. A second sub-array may comprise loudspeakers 332-342, each of which has a quantized attenutaion value of −3 dB, and so on. In TABLE 1, the loudspeakers near the transition points between the sub-arrays such as loudspeakers 332, 348 and 352, despite the quantized attenuation values, were moved to a different sub array to maintain an even number of loudspeakers in each sub arrays. In other examples, other configurations of sub-arrays, such as sub arrays with odd numbers of loudspeakers are possible.

Because there may be five sub-arrays, the twenty loudspeakers 320-354 may be driven by five passive attenuation circuits, and/or five amplifiers. The amplifiers (not shown) for driving the five sub-arrays may be included in the reflective loudspeaker array 300, or may be positioned external to the reflective loudspeaker array 300. Alternatively, each loudspeaker 320-354 or predetermined groups of the loudspeakers 320-354 may be driven by a respective audio amplifier. In still another alternative, fewer or greater numbers of sub-arrays and associated passive attenuation circuits may be employed in a reflective loudspeaker array 300.

Figure 4:
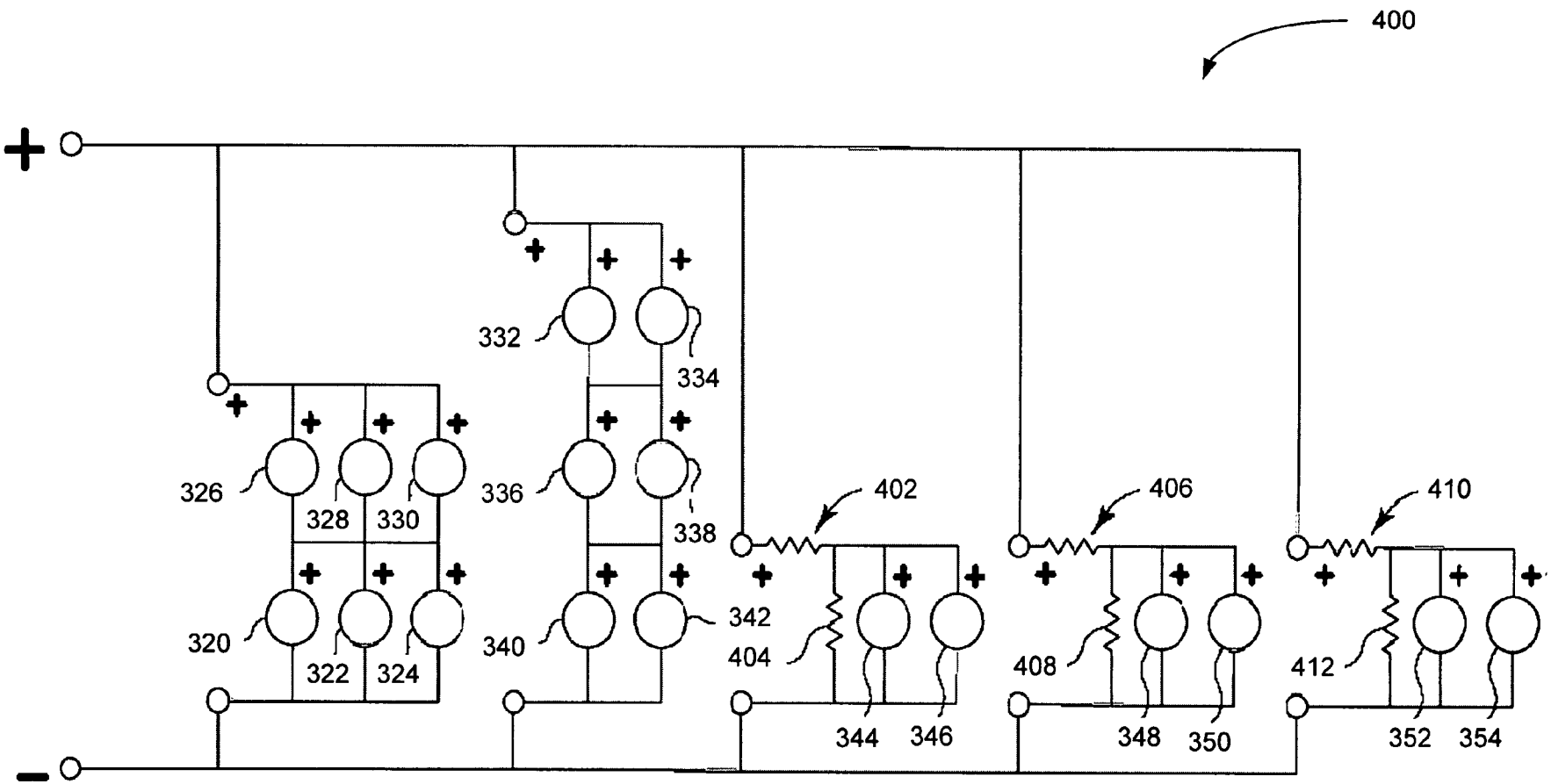
FIG. 4 is a schematic diagram of a passive compensation network for the reflective loudspeaker array of FIG. 3.

FIG. 4 is a schematic diagram of an example loudspeaker driver circuit 400 included in a reflective loudspeaker array, such as the example reflective loudspeaker array 300 of FIG. 3. The loudspeaker driver circuit 400 may be configured to include the approximate attenuation values shown in TABLE 1 with minimal use of electronic components. For the example configuration shown in FIG. 4, the impedance of each of the loudspeakers 320-354 may be about 4.0 Ohms. For constant-beamwidth operation, relative, as opposed to absolute, attenuation of each of the loudspeakers 320-354 is relevant. For example, attenuation for each of loudspeakers 320-354 may be increased or decreased by a constant, as long as each of the loudspeakers 320-354 has a nearly identical change.

The first sub-array comprising the loudspeakers 320-330, may be arranged in a series/parallel combination such that a combined impedance of the first sub-array is about 4.4 Ohms. Likewise, the second sub-array comprising the loudspeakers 332-342, may be arranged such that the combined impedance of the second sub-array is about 9.9 Ohms. A third sub-array, comprising loudspeakers 344-346, may be arranged in a series/parallel combination with a first resistor 402 having an resistance of about 2.5 Ohms and a second resistor 404 having a resistance of about 1.0 Ohms to yield an impedance of about 3.3 Ohms for the third sub-array.

Similarly, a fourth sub array, comprising the loudspeakers 348-350, may be arranged with third resistor 406 having a resistance of about 3.8 Ohms and a fourth resistor 408 having a resistance of about 1.0 Ohm to yield an impedance of about 4.6 Ohms for the fourth sub-array. Finally, a fifth sub-array, comprising the loudspeakers 352-354, may be arranged with fifth resistor 410 having a resistance of about 5.7 Ohms and a sixth resistor 412 having a resistance of about 1.0 Ohms to yield a total impedance of about 6.5 Ohms for the fifth sub-array The impedance of the entire loudspeaker driver circuit 400 may be about 1.0 Ohm. Therefore, as illustrated in FIG. 3, the loudspeakers 320-330 may have no attenuation, the attenuation for the loudspeakers 332-342 may be about −3 dB, for the loudspeakers 344-346 may be about −6 dB, for the loudspeakers 348-350 may be about −9 dB, and for the loudspeakers 352-354 may be about −12 dB. As can be seen from TABLE 1, each of the loudspeakers 320-354 may have an attenuation that is roughly 6 dB below the quantized attenuation value. Because the beamwidth is a function of the relative attenuation (or shading) of the loudspeakers 320-354, the attenuation provided by the example impedance network shown in FIG. 4 conforms to the values shown in Table 1. To use the reflective loudspeaker array with a sound amplifier that has a determined output impedance, such as 4.0 or 8.0 Ohms, an impedance matching transformer (not shown) may be used. Such an impedance matching transformer may be included within the reflective loudspeaker array, or may be positioned between the reflective loudspeaker array and an audio amplifier (not shown) providing power to the reflective loudspeaker array.

The example schematic diagram shown in FIG. 4 allows the reflective loudspeaker array to be constructed with loudspeakers 320-354 with about equal impedances. For mass production, however, it may be desirable to fabricate the loudspeakers 320-354 with differing impedances by custom winding a coil included in each of the loudspeakers 320-354. Furthermore, the reflective loudspeaker array 100 may be constructed for use with multiple amplifiers (not shown). For example, five amplifiers (not shown) may power the five sub-arrays of loudspeakers, so that one amplifier provides power to one sub-array. Such amplifiers may be either internal or external to the reflective loudspeaker array, and may provide desired attenuation without the use of passive components or custom-built speaker drivers.

Figure 5:
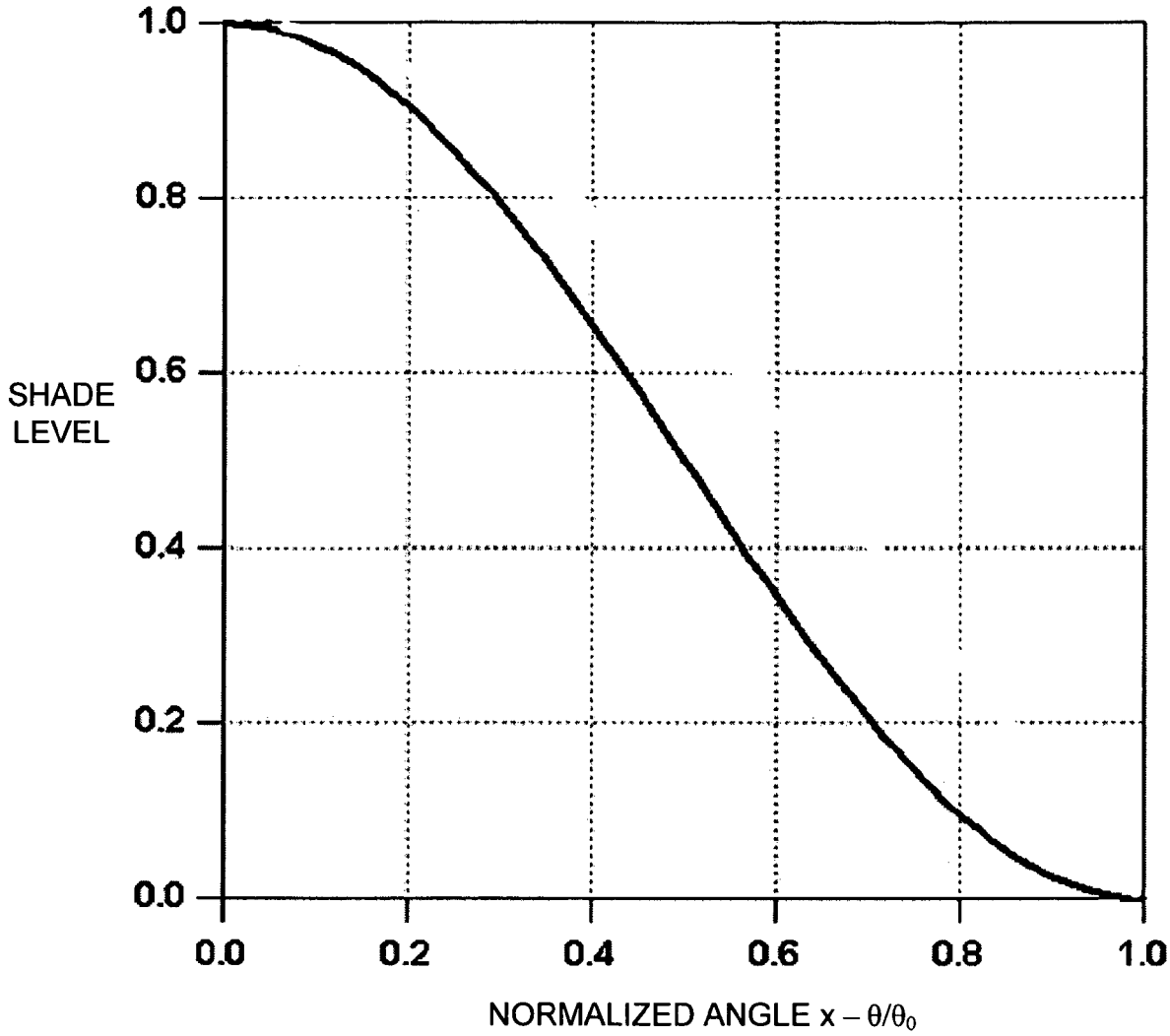
FIG. 5 is an example of attenuation related shading versus height for a reflective loudspeaker array.

FIG. 5 is an example of shading plot for a reflective loudspeaker array that is derivable from any one of Equations 1-4. In FIG. 5, the attenuation applied to the loudspeakers is not quantized, thus, the loudspeakers are not divided into sub-arrays. As previously discussed, shading refers to frequency-independent magnitude-only changes in the level (attenuation) of signals that are applied to each of the loudspeakers in the reflective loudspeaker array to drive the respective loudspeakers. Shading may dramatically reduce side lobes of the reflective loudspeaker array, and may improve off-axis frequency responses.

When the example shading of FIG. 5 is applied to the reflective loudspeaker array, the loudspeaker(s), such as loudspeaker 320, nearest the acoustically reflective planar surface may be on full (un-attenuated) while the loudspeaker(s), such as loudspeaker 354, farthest from the acoustically reflective planar surface at the second end 308 (FIG. 3) may have maximum attenuation. The remaining loudspeakers 322-352 may be uniformly increasingly attenuated based on distance from the first end 306. In FIG. 5, the shading level is plotted against the normalized angle x (TABLE 1) of each of the reflective loudspeakers in the array. Each loudspeaker in the array may be shaded with a value sampled from the curve at its normalized angle x in the array.

Figure 6:
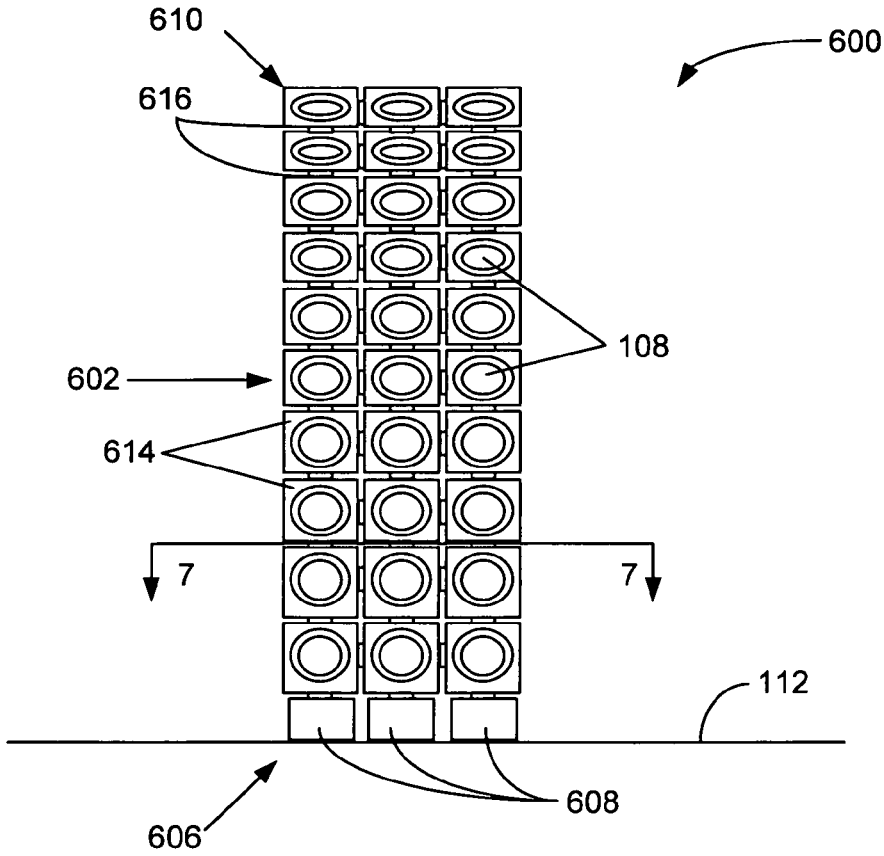
FIG. 6 is a front view of another example of a reflective loudspeaker array positioned adjacent an acoustically reflective planar surface.

FIG. 6 is a front view of another example reflective loudspeaker array 600 that includes a frame 602 and a plurality of loudspeakers 108 disposed on a curved outer surface of the frame 602. The frame 602 includes a first end 606 having a base 608 with a surface that can be positioned adjacently parallel with an acoustically reflective planar surface 112. The frame also includes a second end 610 that is maintained in free air spaced away from the acoustically reflectively planar surface 112.

In addition, the frame 602 includes a plurality of subframes 614. Each of the subframes 614 may be formed of plastic, wood, metal or any other rigid material, and are formed to accommodate being fixedly coupled with one or more of the loudspeakers 108. In one example, the subframes 614 may each be formed to include at least one aperture that is formed to accommodate one or more of the loudspeakers 108. The loudspeakers 108 may be coupled with the respective subframes 614 by fasteners, glue, friction fit, and/or any other coupling mechanism.

The subframes 614 may be coupled with each other to form the frame 602 and a surface to which the loudspeakers 108 may be coupled. The subframes 614 may be moveably coupled with each to form the frame 602 by a plurality of linkages 616. Each of the linkages 616 may be coupled between two adjacently positioned subframes 614 to allow movement in at least one direction and provide rigid support to movement in the remaining directions.

In FIG. 6, the subframes 614 are arranged in horizontal rows consisting of three subframes 614 and vertical columns consisting of ten subframes 614. In other examples, any number of subframes 614 may be included in the columns and/or rows. Each row of subframes 614 includes linkages 616 that allow movement of each of the subframes 614 with respect to the adjacently positioned subframes 614. The linkages 616 may be a flexible member coupled with adjacent subframes 614, such as a hinge, a flexible material or any other material capable of forming a flexible joint between the subframes 614.

Figure 7:
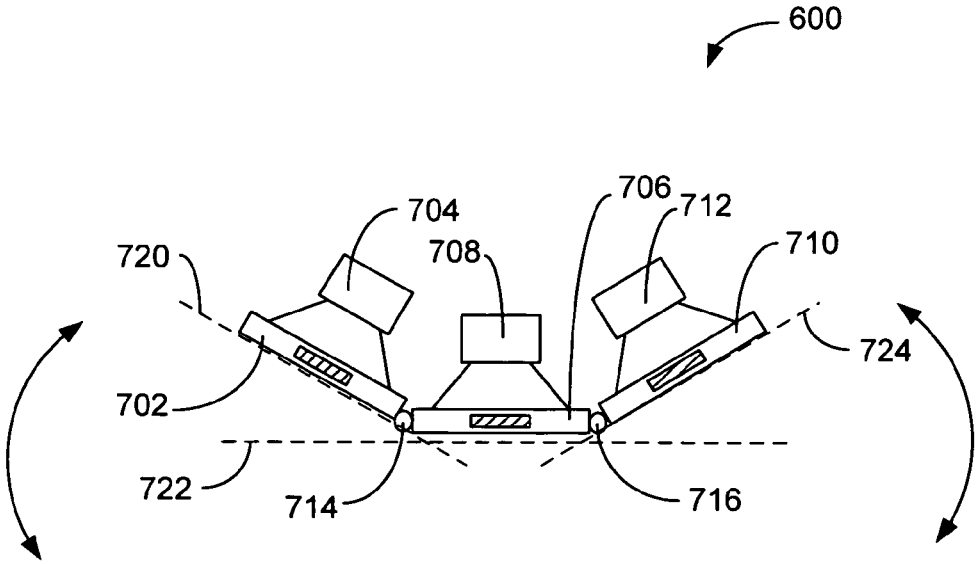
FIG. 7 is a cross-sectional view of a portion of the reflective loudspeaker array illustrated in FIG. 6.

FIG. 7 is a top cutaway view of the frame 602 of the reflective loudspeaker array 600 of FIG. 6 depicting a first subframe 702 and a corresponding first loudspeaker 704, a second subframe 706 and a corresponding second loudspeaker 708 and a third subframe 710 and a corresponding third loudspeaker 712. A lateral edge of the first subframe 702 may be coupled with a first lateral edge of the second subframe 704 with a first linkage 714. In addition, a second lateral edge of the second subframe 704 may be coupled with a lateral edge of the third subframe 706 with a second linkage 716. Thus, each of the first, second and third subframes 702, 704 and 706 are moveable with respect to each other. More specifically, the first and third subframes 702 and 706 may pivot with respect to the second subframe 704. The first and third subframes 702 and 706 may bi-directionally pivot around the first linkage 710 and the second linkage 712. Thus, the first, second and third subframes 702, 706 and 710 are capable of articulating with respect to each other as indicated by arrows in FIG. 7.

As previously described, each of the first, second and third loudspeakers 704, 708 and 712 include a respective sound emitting surface that forms a respective first, second and third frontal plane illustrated as dotted lines 720, 722 and 724, respectively in FIG. 7. Using the first linkage 714, the first subframe 702 may be pivoted to create a determined row angle, between the first frontal plane 720 and the second frontal plane 722. Similarly, using the second linkage 716, the third subframe 710 may be pivoted to create a determined row angle, between the third frontal plane 724 and the second frontal plane 722. The row angles can be plus and minus 45 degrees, for example.

The movement of the first and third subframes 702 and 710 with respect to the second subframe 706 may adjust the sound coverage pattern of a row of loudspeakers 108, such as a horizontal coverage pattern. For example, if the row angles of the first, second and third subframes 702, 706, 710 were about plus 45 degrees, the pattern produced by operation of the respective loudspeakers would be wider than when the row angles of the first, second and third subframes 702, 706, 710 were about 0 degrees (i.e., the first, second, and third frontal planes 720, 722, and 724 were parallel and in the same linear plane).

Figure 8:
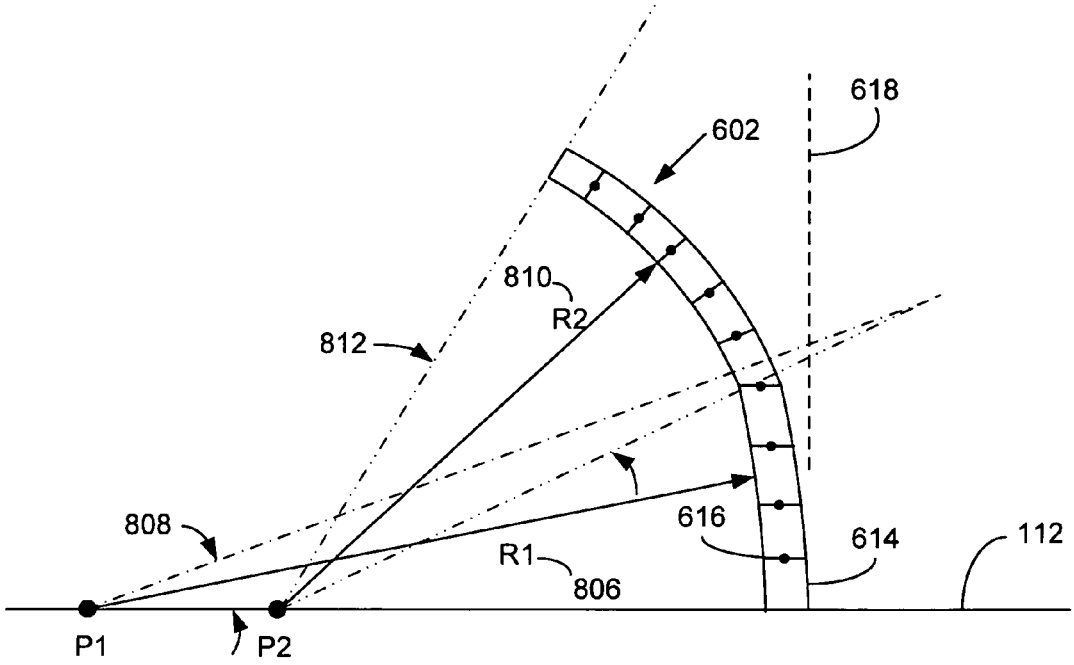
FIG. 8 is a side view of the reflective loudspeaker array illustrated in FIG. 6.

FIG. 8 is a side view of the reflective loudspeaker array 600 of FIG. 6 with the subframes 614 pivoted with respect to each other to form an example frame configuration. As previously discussed with reference to FIG. 1, the frame 102 of a reflective loudspeaker array 100 may be formed with a continuous radius of curvature with a predetermined angle. With the reflective loudspeaker array 600 of FIG. 6 that includes the subframes 614 movably coupled by the linkages 616, configurations with other than a continuous radius of curvature are possible. In the illustrated example, portions of the frame may be formed with different angles of curvature to provide upper and lower pattern control of the sound field produced by the loudspeakers 108 (not shown). Similar to the previous examples, a loudspeaker in the reflective loudspeaker array 600 that is positioned nearest the acoustically reflective planar surface 112 may be substantially parallel with the acoustically reflective planar surface as evidenced by a dotted line 618 that is normal to the acoustically reflective planar surface 112.

In FIG. 8 the frame configuration includes a first portion of the frame 602 that is movably formed with a first radius of curvature (R1) 806 at a first column angle 808. In addition, the frame configuration includes a second portion of the frame 602 that is fashioned with a second radius of curvature (R2) 810 at a second column angle 812. The first and second radius of curvatures 806 and 810 may be at different angles to adjust portions of the coverage area, such as vertical coverage by portions of the reflective loudspeaker array 600. In the illustrated example, the first column angle 808 may be about 20 degrees, and the second column angle 812 may be about 40 degrees to form a 2:1 ratio between the two column angles. In other examples, other ratios of angles that are less than 2:1 may be used with favorable results. In addition, in other examples, additional radius of curvature may be employed, such as a different radius of curvature for each of five sub arrays. In still further examples, the angles of the radius of curvature of the portions of the reflective loudspeaker array 600 may be five degrees or greater. Since the reflective loudspeaker array 600 is operational adjacent to an acoustically reflective planar surface 112, a mirror image reflective loudspeaker array with the same radius(ii) of curvature may form the composite virtual array, as previously described. As also previously described, the direct sound waves and the reflected sound waves are positively combined to form an acoustic image with the previously described effects and advantages.

Using the articulatable reflective loudspeaker array 600, the horizontal and vertical coverage may adjusted to a desired configuration to best direct the coverage beam at the listeners in a given listening area configuration. For example, if the articulatable reflective loudspeaker array 600 is positioned above a first group of listeners, and also positioned beside a second group of listeners, such as positioned on a ceiling of a listening area having a lower floor and a balcony, the angles of curvature of each portion of the reflective loudspeaker array 600 may be adjusted accordingly to tailor the vertical height of the response provided to each of the two groups of listeners located at different vertical heights with respect to the reflective loudspeaker array 600. In addition, the previously discussed vertical shading may be employed to further focus the beam. Further, the horizontal coverage of the articulatable reflective loudspeaker array 600 may be adjusted to widen or narrow the horizontal coverage area being provided to the groups of listeners. In addition, horizontal shading may be use similar to vertical shading. As such, the reflective loudspeaker array 600 may have a focused and yet vertically and horizontally adjustable coverage area that can be tailored to a particular listening room configuration and/or listener positioning to minimize reverberation and other undesirable reflection related effects.

Figure 9:
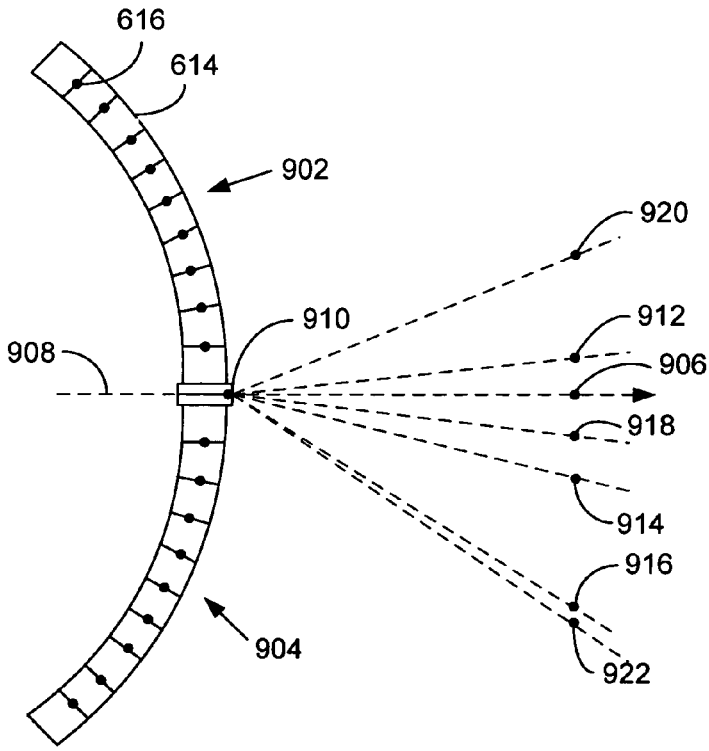
FIG. 9 is an example of a pair of reflective loudspeaker arrays in cooperative operation.

FIG. 9 is an illustration of a pair of the reflective loudspeaker arrays 600 illustrated in FIG. 6 placed in an end-to-end configuration, such that the bases may be contiguously aligned and centrally positioned. In this configuration, a first reflective loudspeaker array 902 and a second reflective loudspeaker array 904 may be positioned to form a curved loudspeaker array that is similar to the previously discussed free standing array. In this configuration, the first reflective loudspeaker array 902 and the second reflective loudspeaker array 904 may be placed away from an acoustically reflective surface, since the combination may make generation of a mirror image (202—FIG. 2) unnecessary. However, with the articulatable loudspeaker arrays 600, the horizontal and vertical coverage of the arrays are adjustable. With regard to an angle of a radius of curvature, each of the first and second articulatable loudspeaker arrays 902 and 904 may include one or more radius of curvature as previously discussed. In addition, the rows of loudspeakers 108 (not shown) may be articulated to develop a desired beam width as previously discussed. Further, horizontal and vertical shading may be employed. Accordingly, any asymmetrical array may be formed.

Using an asymmetrical array, the response of the array may be tailored to the listening audience to have asymmetrical coverage patterns. The asymmetrical coverage patterns may be individually focused on different listening spaces having different acoustical features. For example, the first reflective loudspeaker array 902 may be adjusted to a radius of curvature with a narrow vertical coverage area for a listening area of generally the same vertical height, while the second reflective loudspeaker array 904 may be adjusted to a radius of curvature for a broad vertical coverage area for a listening space of a gradually increasing vertical height. Thus, by using the asymmetrical array, such coverage patterns may avoid arbitrarily reflected sound energy off surrounding structures, which can degrade speech intelligibility by increased reverberation and other interference. Customizing, the asymmetrical array with different angles of curvature that enable a focused beamwidth of sound field coverage that avoids arbitrary reflections.

Performance of a prototype of the reflective loudspeaker array was also compared with a conventional powered two-way compact monitor with dimensions of 173 mm×269 mm×241 mm and a straight line array to demonstrate the significantly enhanced performance and unexpected results of the reflective loudspeaker array. All systems were measured over the same acoustically reflective planar surface, which was a tile floor located in a large warehouse space. The center fronts of all three systems were located at the origin of the measurement region at a distance of 0.0 m. The above-ground-plane sound field of each of these systems was investigated by measuring a number of frequency responses in-front-of and to-the-side of the systems.

Figure 10:
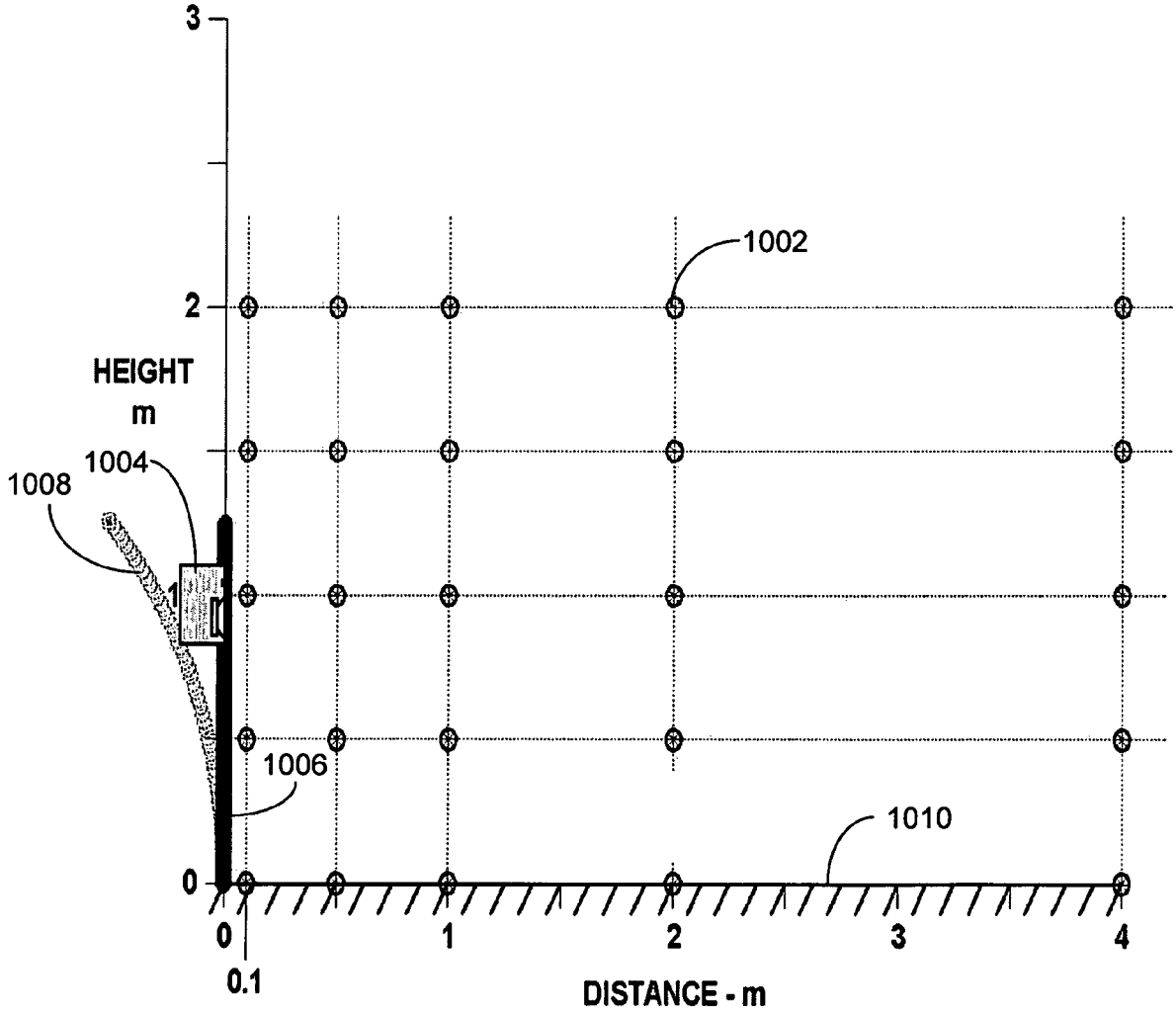
FIG. 10 is a schematic of a vertical plane sampling grid depicting a plurality of sample points over an acoustically reflective planar surface.

FIG. 10 depicts a vertical-plane sound field with twenty-five grid sample points 1002 positioned in front of each of a compact monitor system 1004, a straight line array system 1006 and a reflective loudspeaker array system 1008, and over an acoustically reflective planar surface 1010. The sample points 1002 are positioned at distances of 0.1, 0.5, 1.0, 2.0, and 4.0 m from each of the systems, and at heights of 0.0, 0.5, 1.0, and 2.0 m above the acoustical reflective surface 1010. The one meter high sample points were essentially on a horizontal axis of the compact monitor 1004 used for the comparison testing. The sample points at a distance of 0.1 m are very close to the front of the systems.

Figure 11:
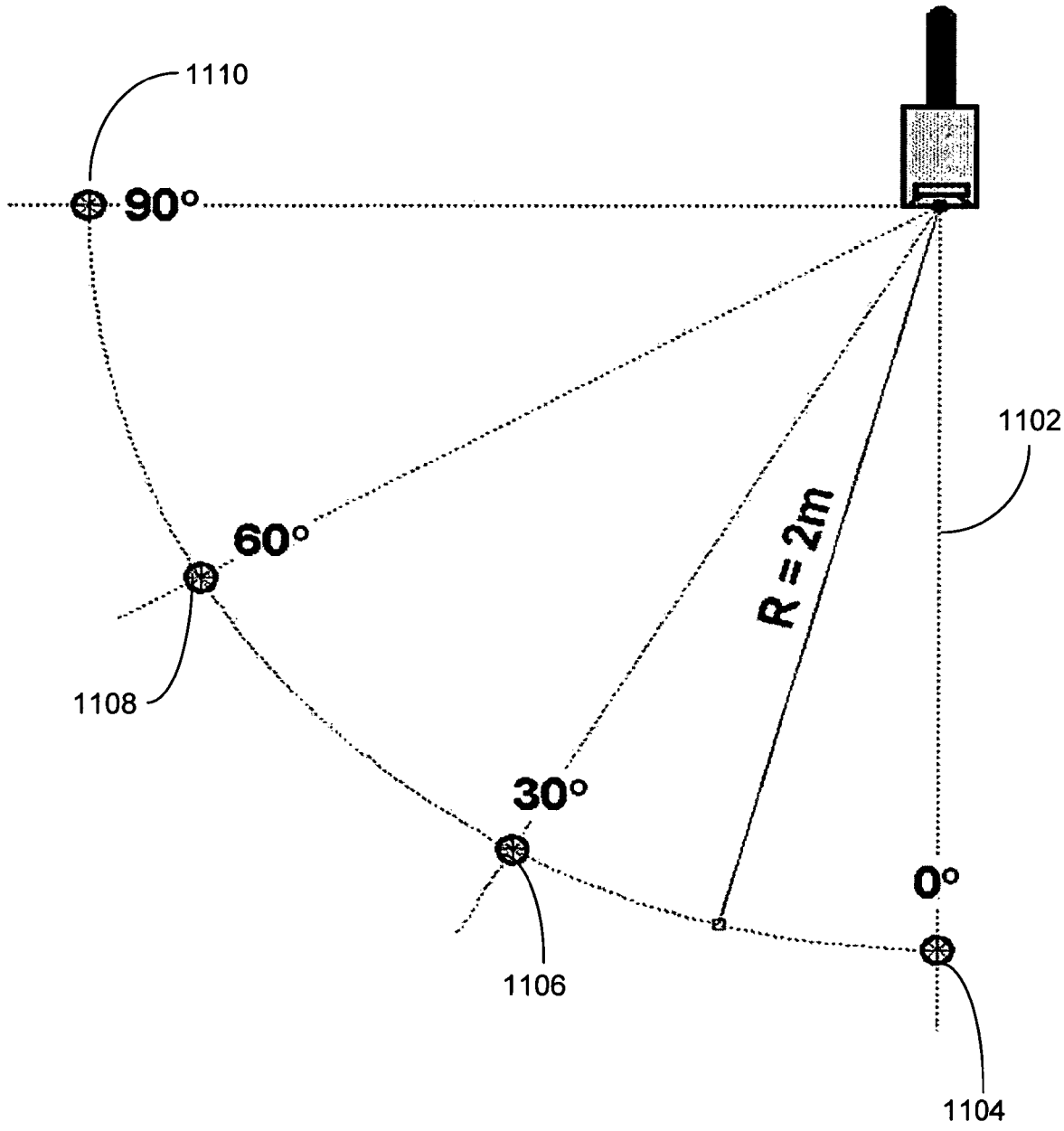
FIG. 11 is a plan view of the vertical plane sampling grid of FIG. 10 depicting a plurality of sampling points at various angles over an acoustically reflective planar surface.

FIG. 11 is a plan view of the vertical plane sound field of FIG. 10 depicting a plurality of off axis angles with respect to a central axis 1102 at which additional samples were taken for each of the systems 1004, 1006, and 1008 (FIG. 10) at a distance of two meters and a height of one meter above an acoustically reflective planar surface 1010 (FIG. 10). In FIG. 11, a first sample 1104 was taken at zero degrees from the central axis 1102, a second sample 1106 was taken at thirty degrees, a third sample 1108 was taken at sixty degrees, and a fourth sample 1110 was taken at ninety degrees.

Figure 12:
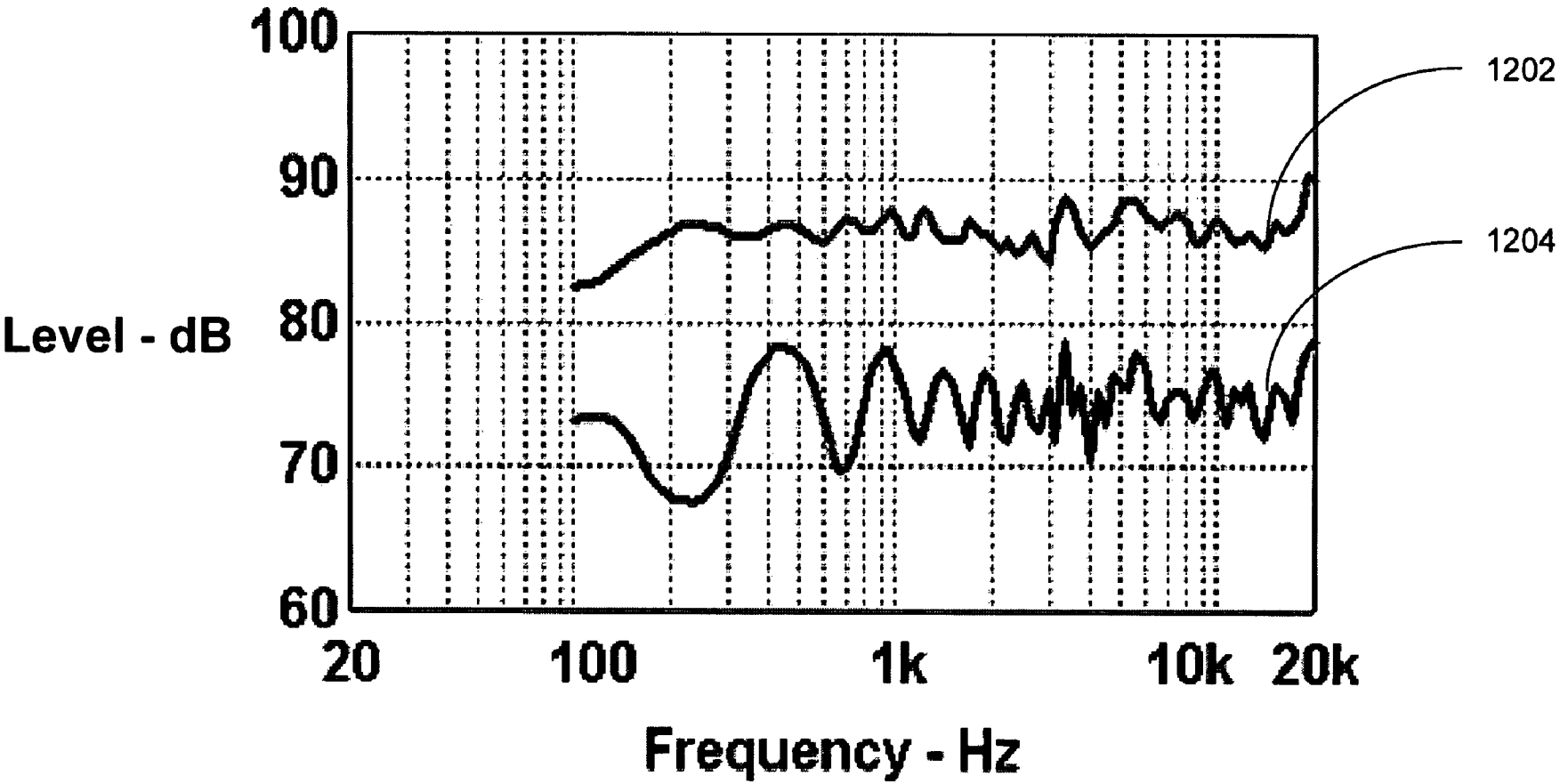
FIG. 12 is an on-axis response for a compact monitor at a height of one meter above an acoustically reflective planar surface.

FIG. 12 is a frequency response illustrating two on-axis responses of the compact monitor 1004 of FIG. 10. A first frequency response 1202 was taken at a distance of 0.5 meters from the compact monitor 1004 and at the sample point that is at a height of one meter above the acoustically reflective planar surface 1010. A second frequency response 1204 was taken at the sample point that is at a distance of 2 meters from the compact monitor 1004 and at a height of one meter above the acoustically reflective planar surface 1010. The first frequency response 1202 does not suffer from the effects of reflected sound waves (or bounce) from the acoustically reflective planar surface because the direct sound wave signal is much stronger than the reflected sound wave signal. However, the second frequency response 1204 shows clear effects of reflected sound waves as illustrated by the undesirable comb effect.

Figure 13:
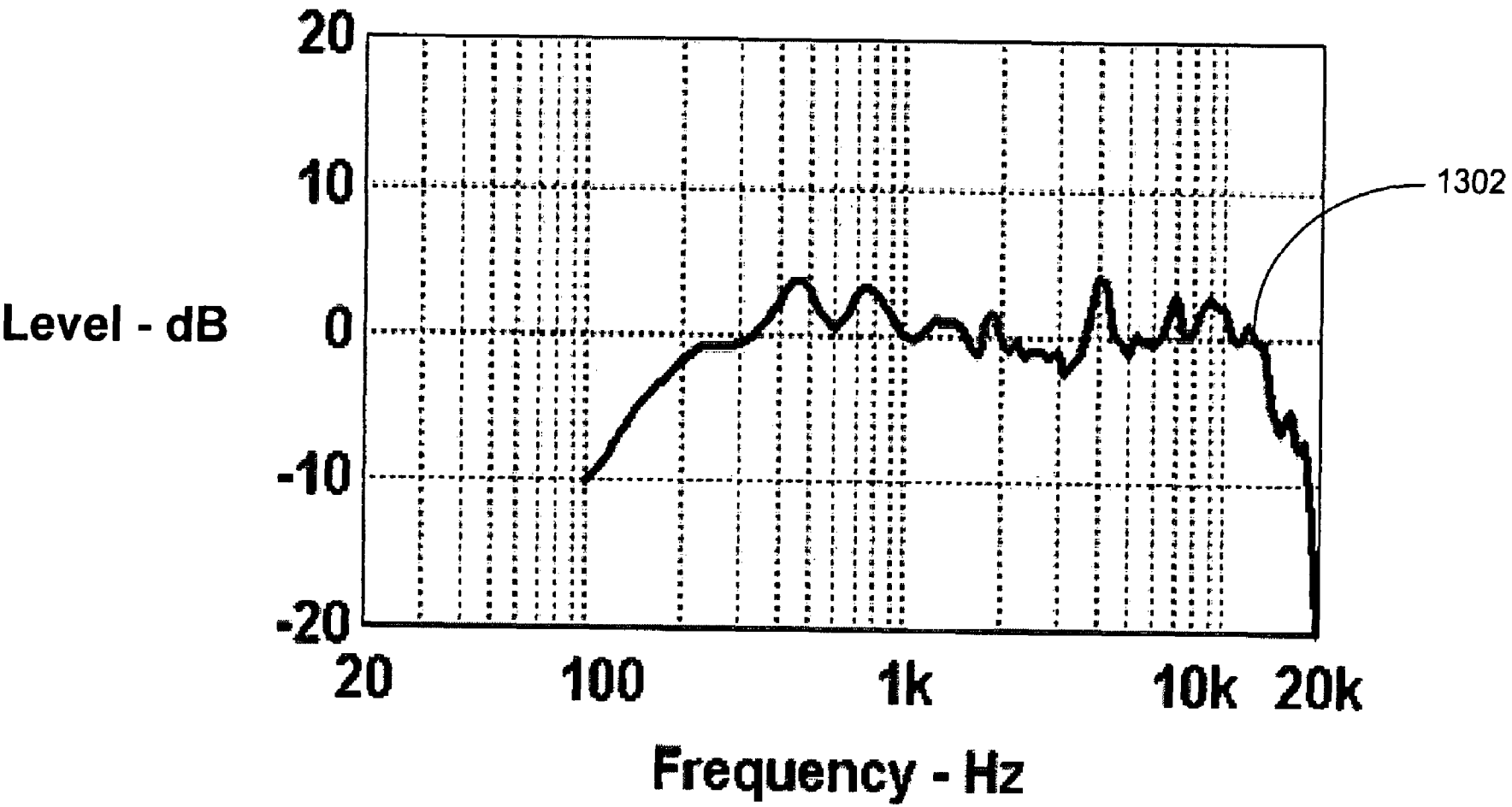
FIG. 13 is an on-axis response for a straight line array at a height of one meter above an acoustically reflective planar surface.

FIG. 13 illustrates a frequency response 1302 for a normalized at 1 kHz on-axis response of the straight line array 1006 of FIG. 10. The frequency response 1302 was taken from the sample point that is at a distance of 2 meters from the straight line array 1006 and at a height of one meter above the acoustically reflective planar surface 1010.

Figure 14:
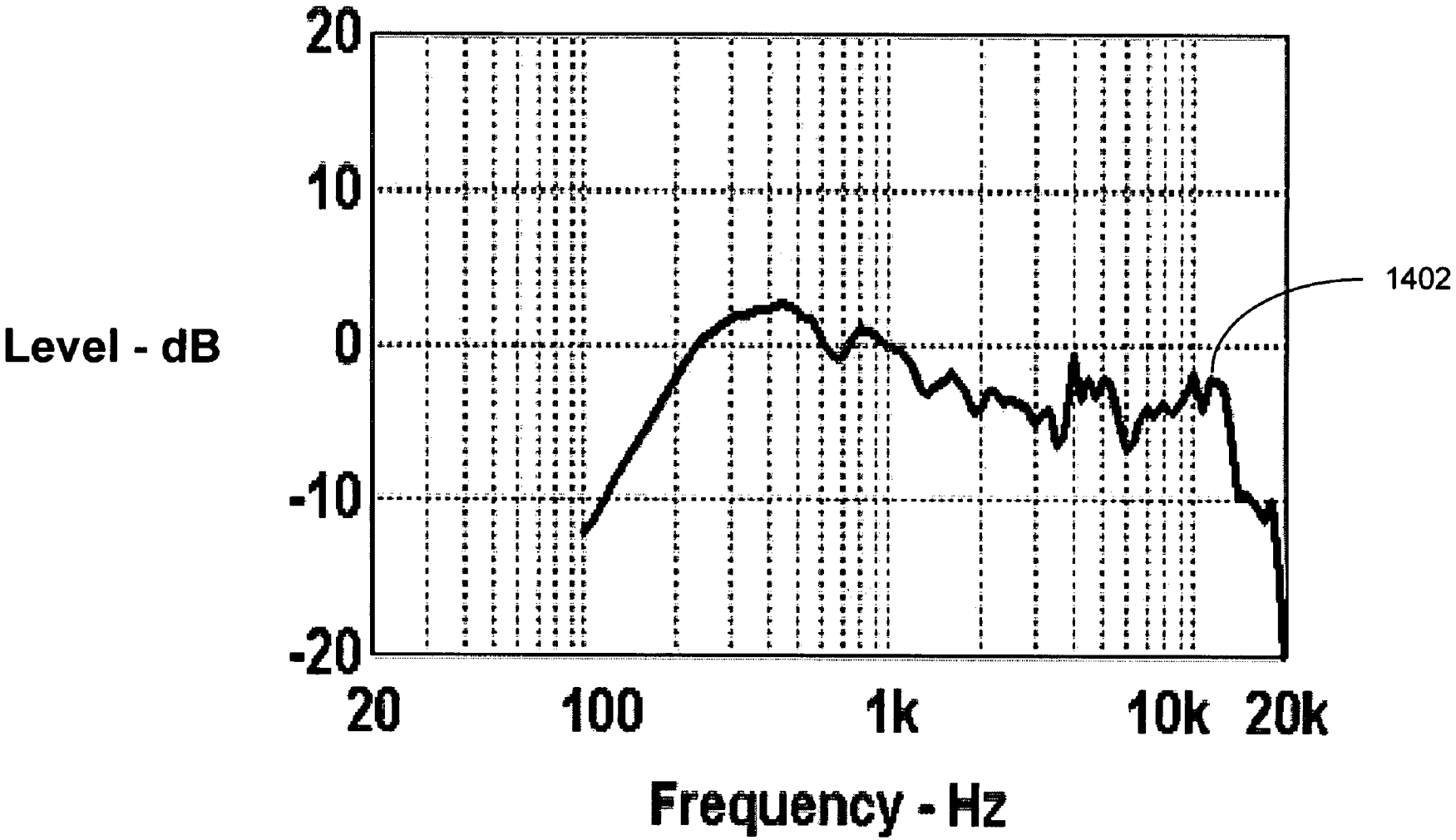
FIG. 14 is an on-axis response for a reflective loudspeaker array at a height of one meter above an acoustically reflective planar surface.

FIG. 14 illustrates a frequency response 1402 for a normalized at 1 kHz on-axis response of the reflective loudspeaker array 1008 of FIG. 10. The frequency response 1402 was taken at the sample point that is at a distance of 2 meters from the reflective loudspeaker array 1008 and at a height of one meter above the acoustically reflective planar surface 1010. Compare the second frequency response curve 1204 of FIG. 12 with the frequency responses of FIGS. 13 and 14, it can be seen that the frequency responses of FIGS. 13 and 14 do not suffer from the effects of reflected sound wave signal bounce from the acoustically reflective planar surface 1010.

Figure 15:
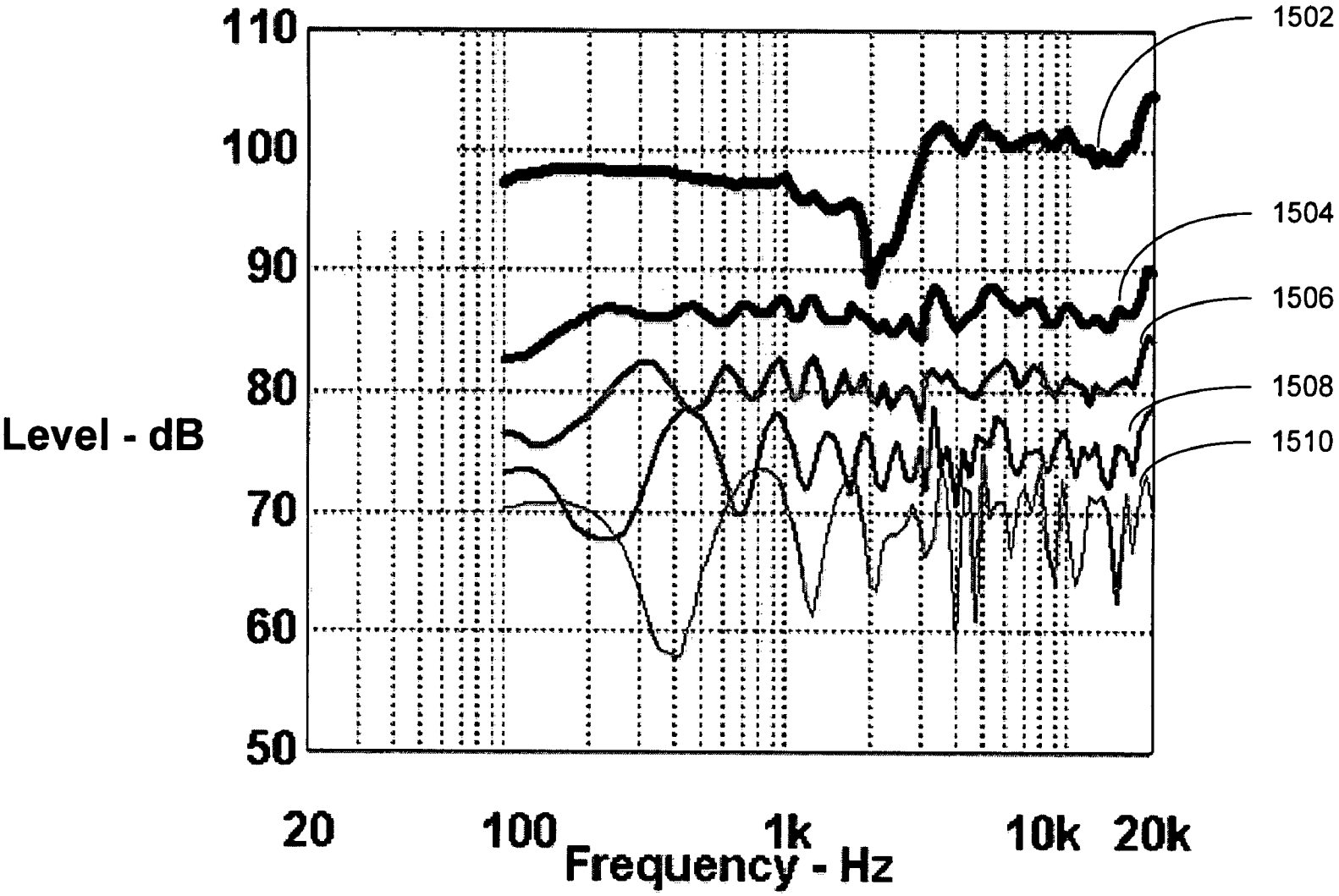
FIG. 15 is a plurality of responses of a compact monitor at the distances indicated by the sample points depicted in FIG. 10 at a height of one meter above an acoustically reflective planar surface.
Figure 16:
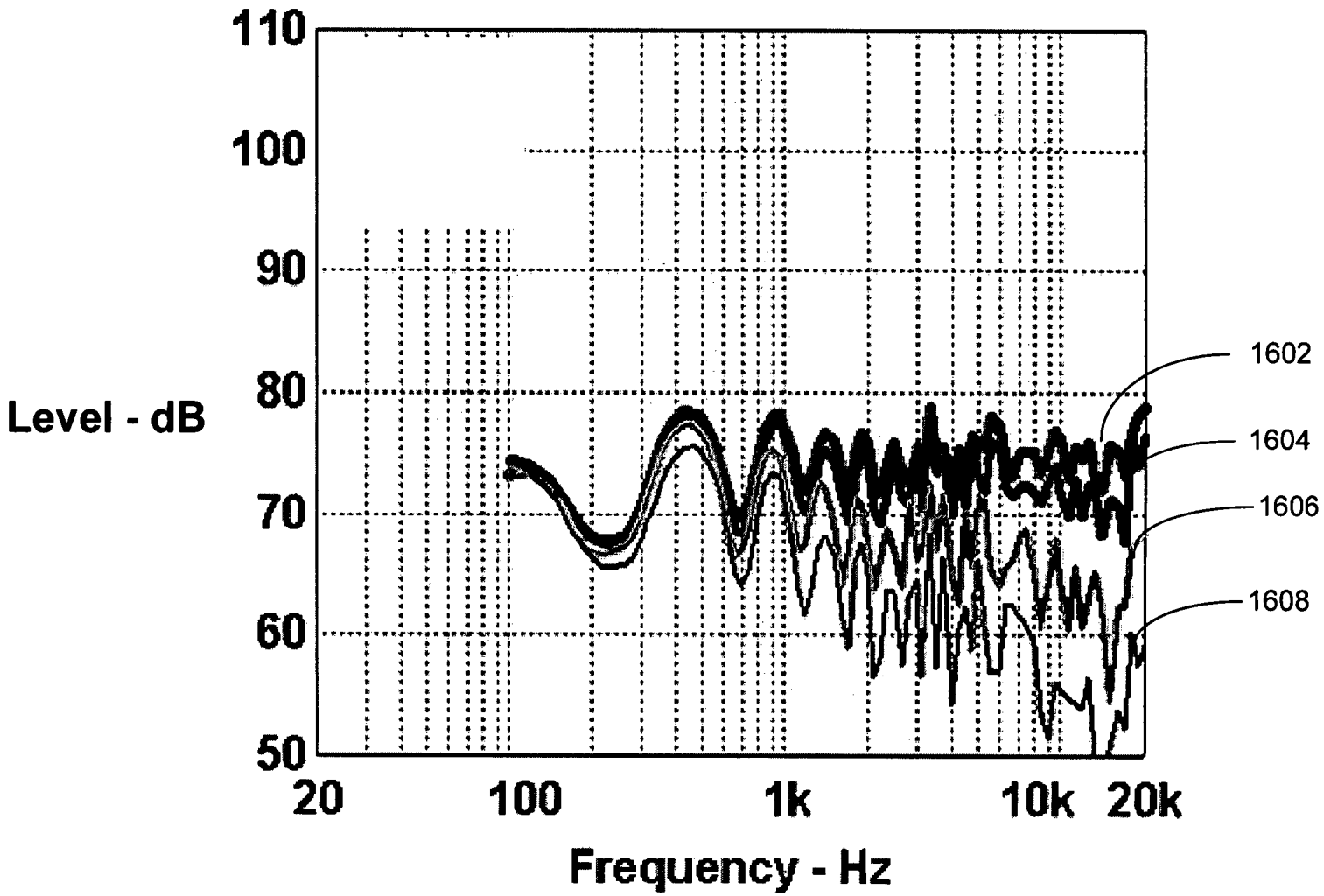
FIG. 16 is a plurality of responses of a compact monitor at the sampling point angles depicted in FIG. 11 at a height of one meter above an acoustically reflective planar surface.

FIGS. 15 and 16 illustrate the variation in frequency response of the compact monitor 1004 with distance (FIG. 15) and angle (FIG. 16). In FIG. 15, samples were taken at the sample points 1002 of FIG. 10 at a height of one meter to generate a first frequency response curve 1502 at 0.1 meters, a second frequency response curve 1504 at 0.5 m, a third frequency response curve 1506 at 2.0 meters, a fourth frequency response curve 1508 at 2.0 meters and a fifth frequency response curve 1510 at 4.0 meters. In FIG. 16, samples were taken at the first sample point 1104 to generate a first frequency response curve 1602, at the second sample point 1106 to generate a second frequency response curve 1604, at the third sample point 1108 to generate a third frequency response curve 1606, and at the fourth sample point 1110 to generate a fourth frequency response curve 1608.

With regard to the frequency responses of FIG. 15, at the one meter height and the indicated distances, which are on the system's axis, the overall curve shape is roughly flat but exhibits dramatic changes in response detail, roughness, and level with increasing distance. The farthest illustrated distance (4 m) exhibits the greatest undulations due to signal bounce. With regard to the frequency responses of FIG. 16, at the one meter height and the indicated angles, which is level with the system's axis, the curves exhibit upper-mid and high-frequency rolloff coupled with up-down undulations due to reflections from the acoustically reflective planar surface 1010.

Figure 17:
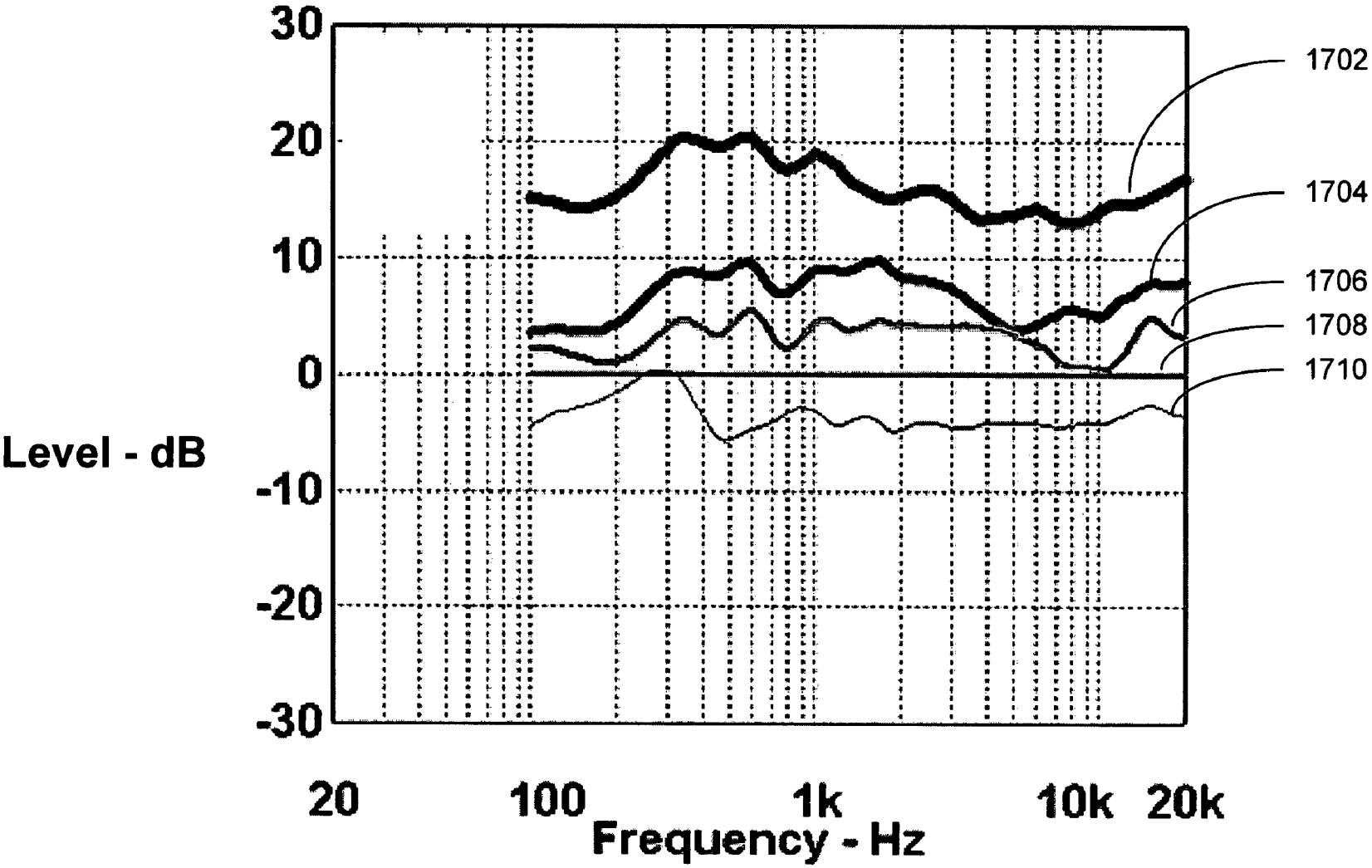
FIG. 17 is a plurality of responses of a straight line array at distances indicated with the sample points depicted in FIG. 10 at a height of one meter above an acoustically reflective planar surface.
Figure 18:
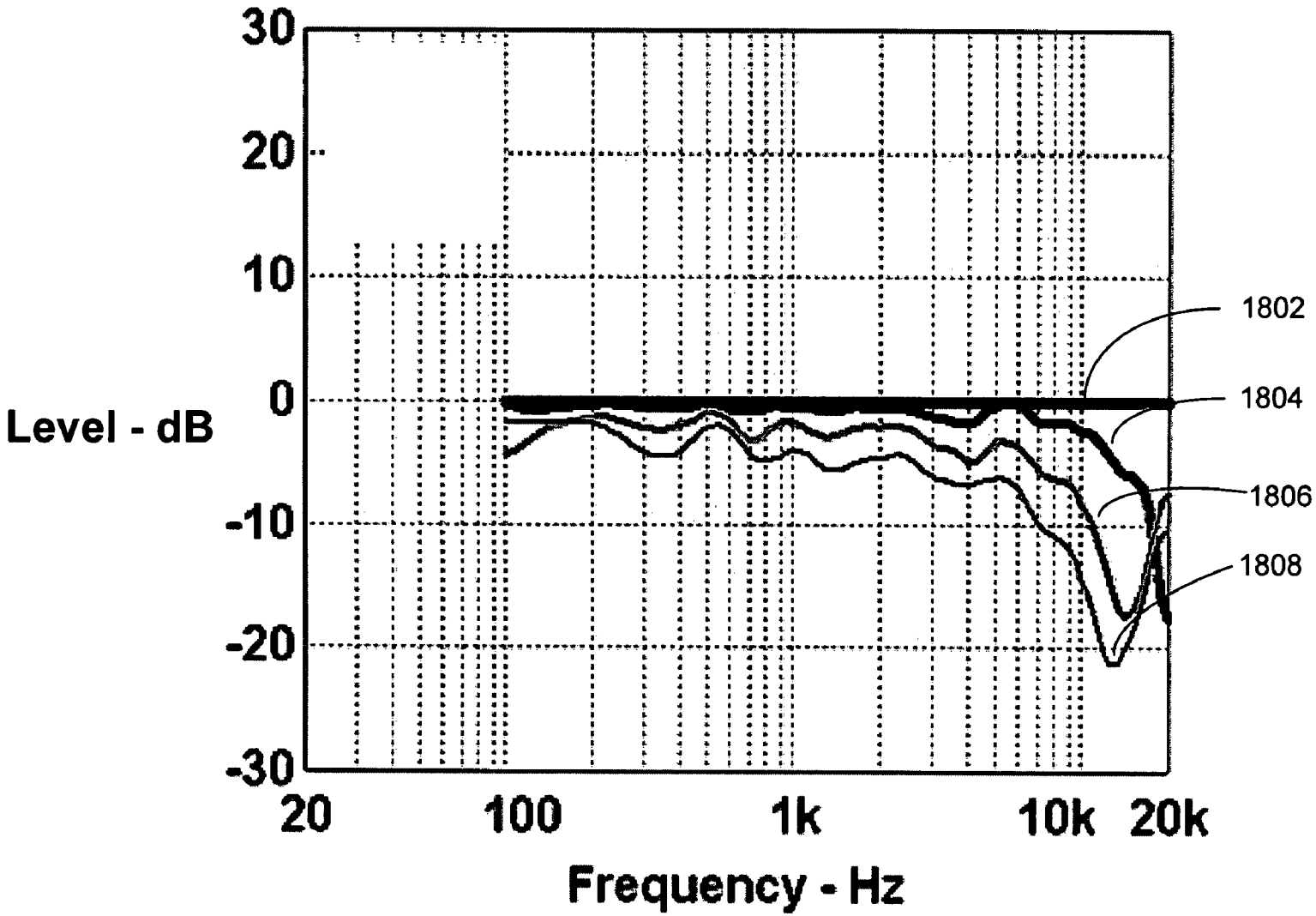
FIG. 18 is a plurality of responses of a straight line array at the sampling point angles depicted in FIG. 11 at a height of one meter above an acoustically reflective planar surface.

FIGS. 17 and 18 similarly illustrate the variation in frequency response of the straight line array 1006 with distance (FIG. 17) and angle (FIG. 18). In FIG. 17, samples were taken at the sample points 1002 of FIG. 10 at a height of one meter to generate a first frequency response curve 1702 at 0.1 meters, a second frequency response curve 1704 at 0.5 m, a third frequency response curve 1706 at 2.0 meters, a fourth frequency response curve 1708 at 2.0 meters and a fifth frequency response curve 1710 at 4.0 meters. In FIG. 18, samples were taken at a height of one meter at the first sample point 1104 to generate a first frequency response curve 1802, at the second sample point 1106 to generate a second 20 frequency response curve 1804, at the third sample point 1108 to generate a third frequency response curve 1806, and at the fourth sample point 1110 to generate a fourth frequency response curve 1808.

In FIG. 17, at the various distances, which were within the 1.25 m array's height, the frequency response curves evidence significant level differences that range over nearly 25 dB. More importantly, the frequency response shape changes quite significantly over this distance range. The system is effectively equalized flat at the 2.0 m distance of frequency response 1708 due to normalization that was performed to the on axis response. Closer to the straight line array, a boost of about 5 to 8 dB in the 300 Hz to 3 kHz range is evident. At the farther distance (4 m) the response is quite flat except for a peak at 200 Hz. In FIG. 18, the curves are surprisingly flat, consistent, and smooth with all the angles only exhibiting the expected high-frequency rolloff.

Figure 19:
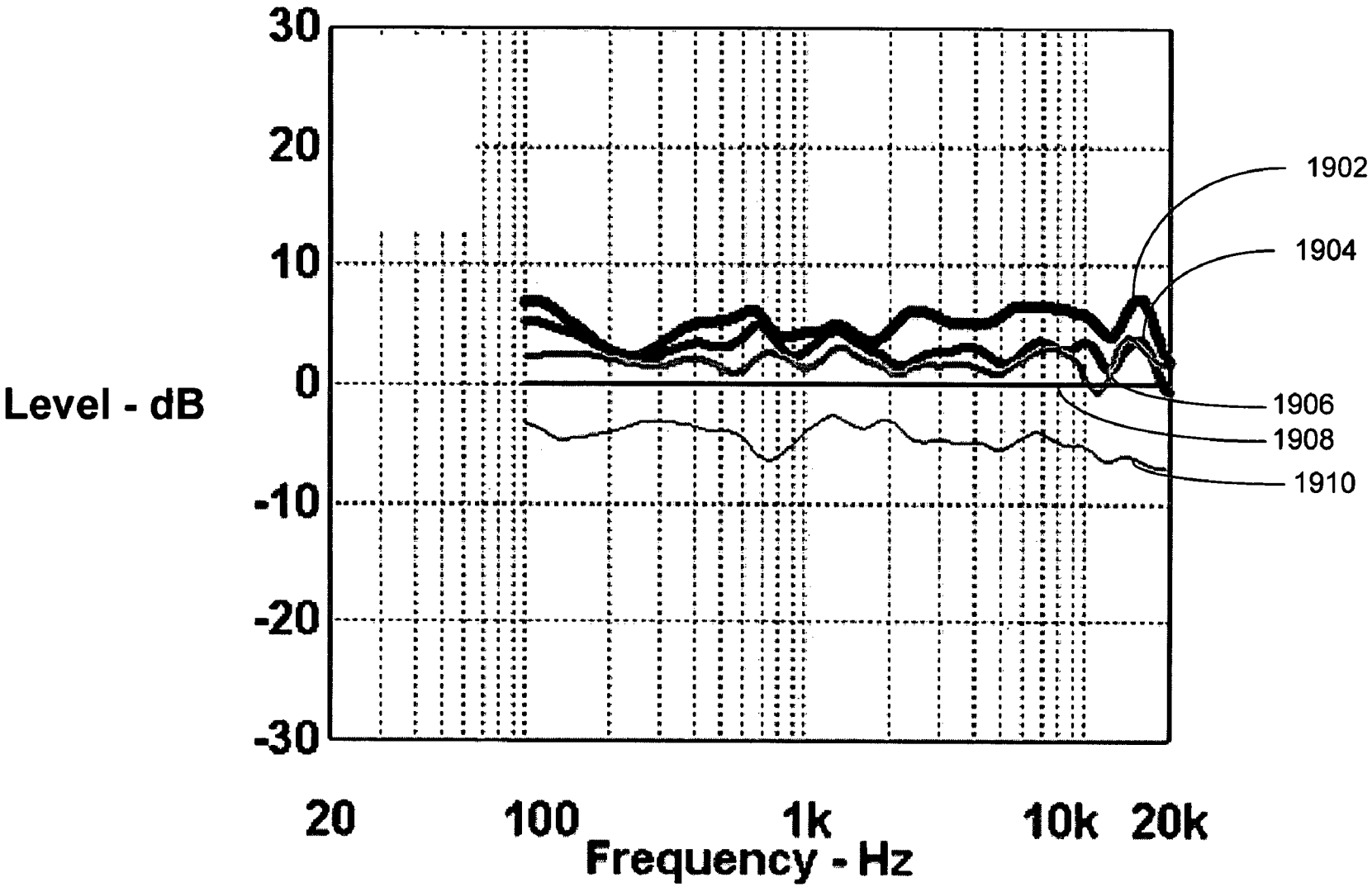
FIG. 19 is a plurality of responses of a reflective loudspeaker array at distances indicated with the sample points depicted in FIG. 10 at a height of one meter above an acoustically reflective planar surface.
Figure 20:
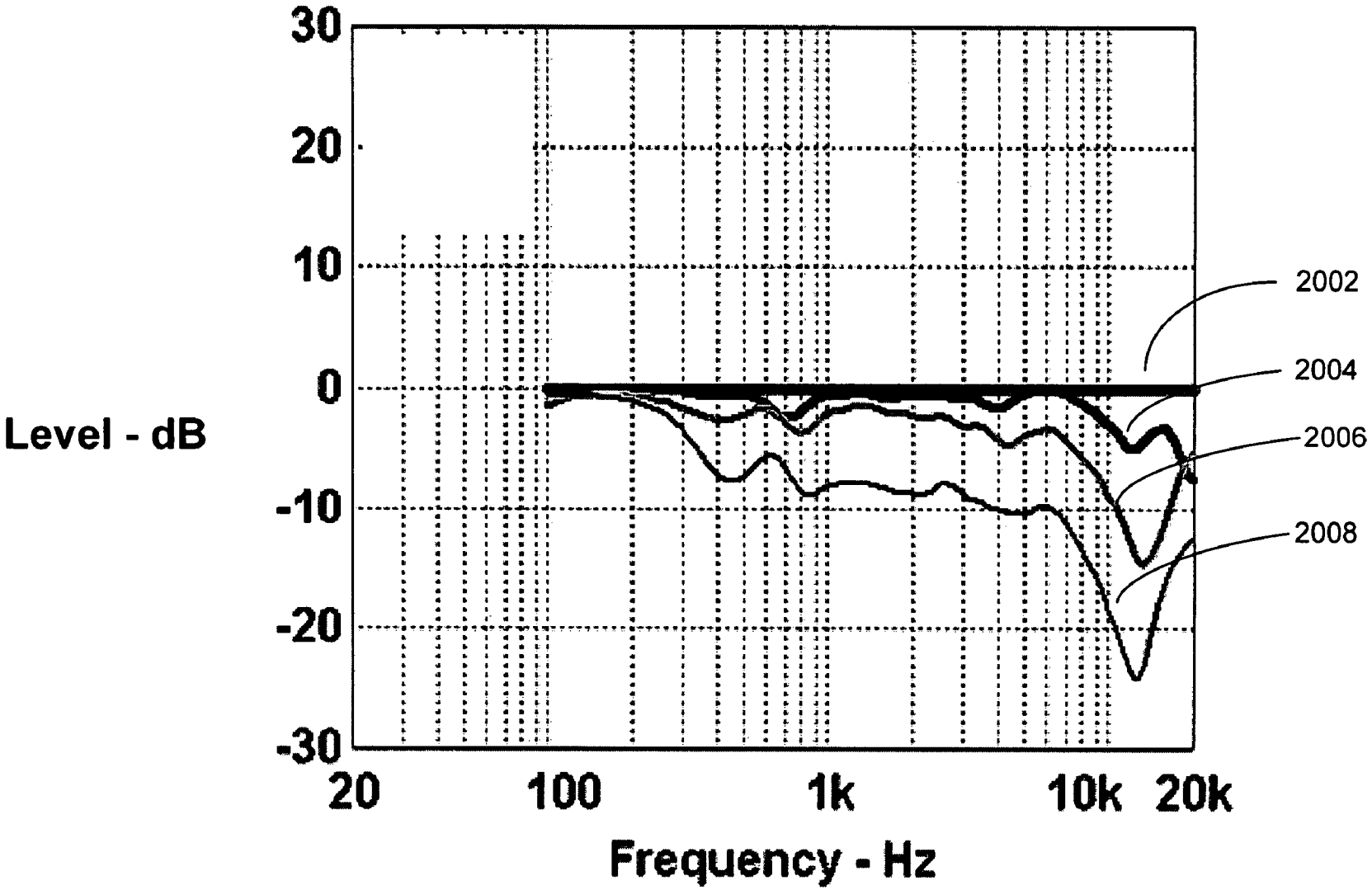
FIG. 20 is a plurality of responses of a reflective loudspeaker array at the sampling point angles depicted in FIG. 11 at a height of one meter above an acoustically reflective planar surface.

FIGS. 19 and 20 similarly illustrate the variation in frequency response of the reflective loudspeaker array 1008 with distance (FIG. 19) and angle (FIG. 20). In FIG. 19, samples were taken at the sample points 1002 of FIG. 10 at a height of one meter to generate a first frequency response curve 1902 at 0.1 meters, a second frequency response curve 1904 at 0.5 meters, a third frequency response curve 1906 at 2.0 meters, a fourth frequency response curve 1908 at 2.0 meters and a fifth frequency response curve 1710 at 4.0 meters. In FIG. 20, samples were taken at a height of one meter at the first sample point 1104 to generate a first frequency response curve 2002, at the second sample point 1106 to generate a second frequency response curve 2004, at the third sample point 1108 to generate a third frequency response curve 2006, and at the fourth sample point 1110 to generate a fourth frequency response curve 2008.

Figure 21:
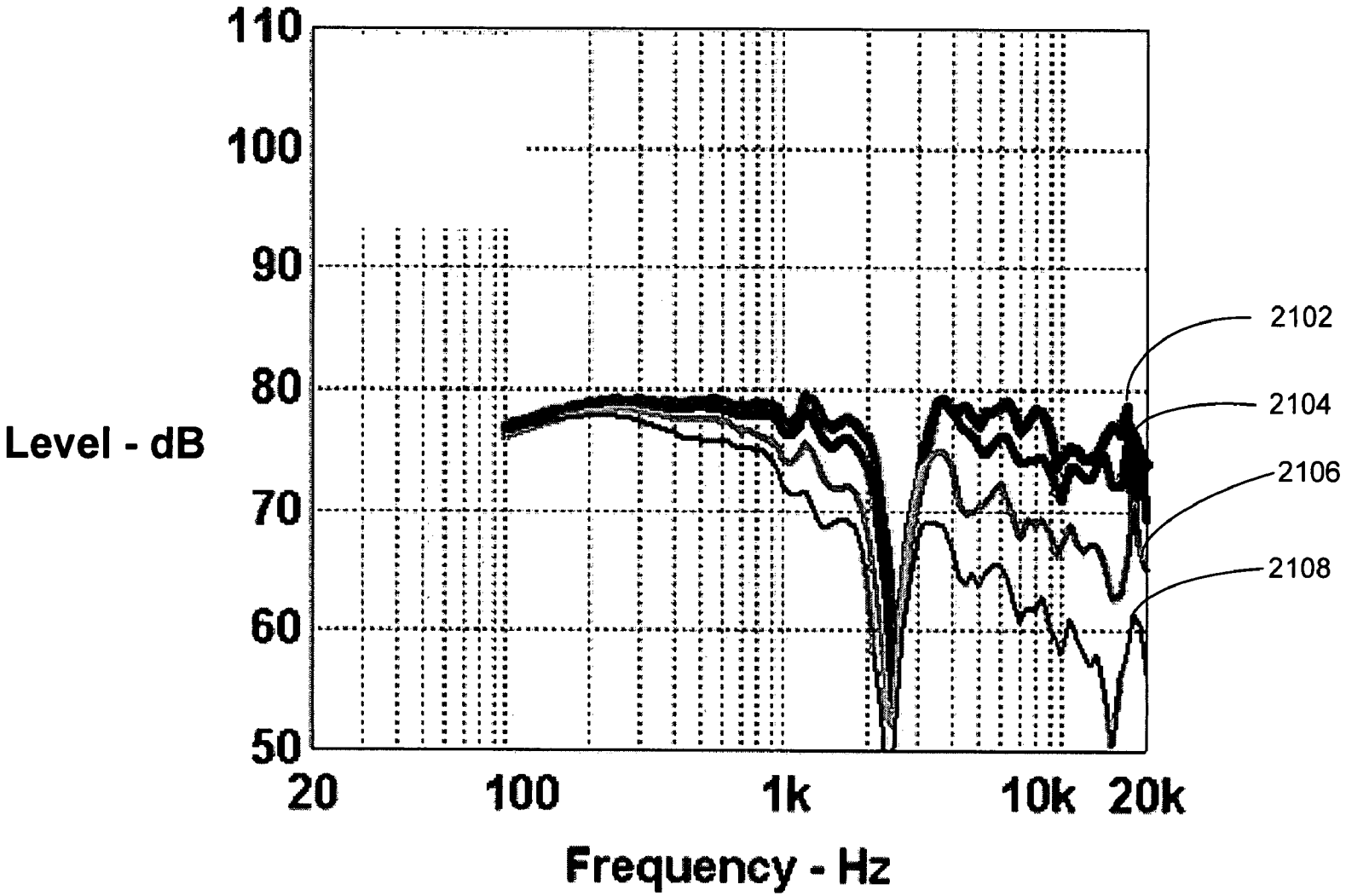
FIG. 21 is a plurality of responses of a compact monitor at the sampling point angles depicted in FIG. 11 at a height of zero meters above an acoustically reflective planar surface.
Figure 22:
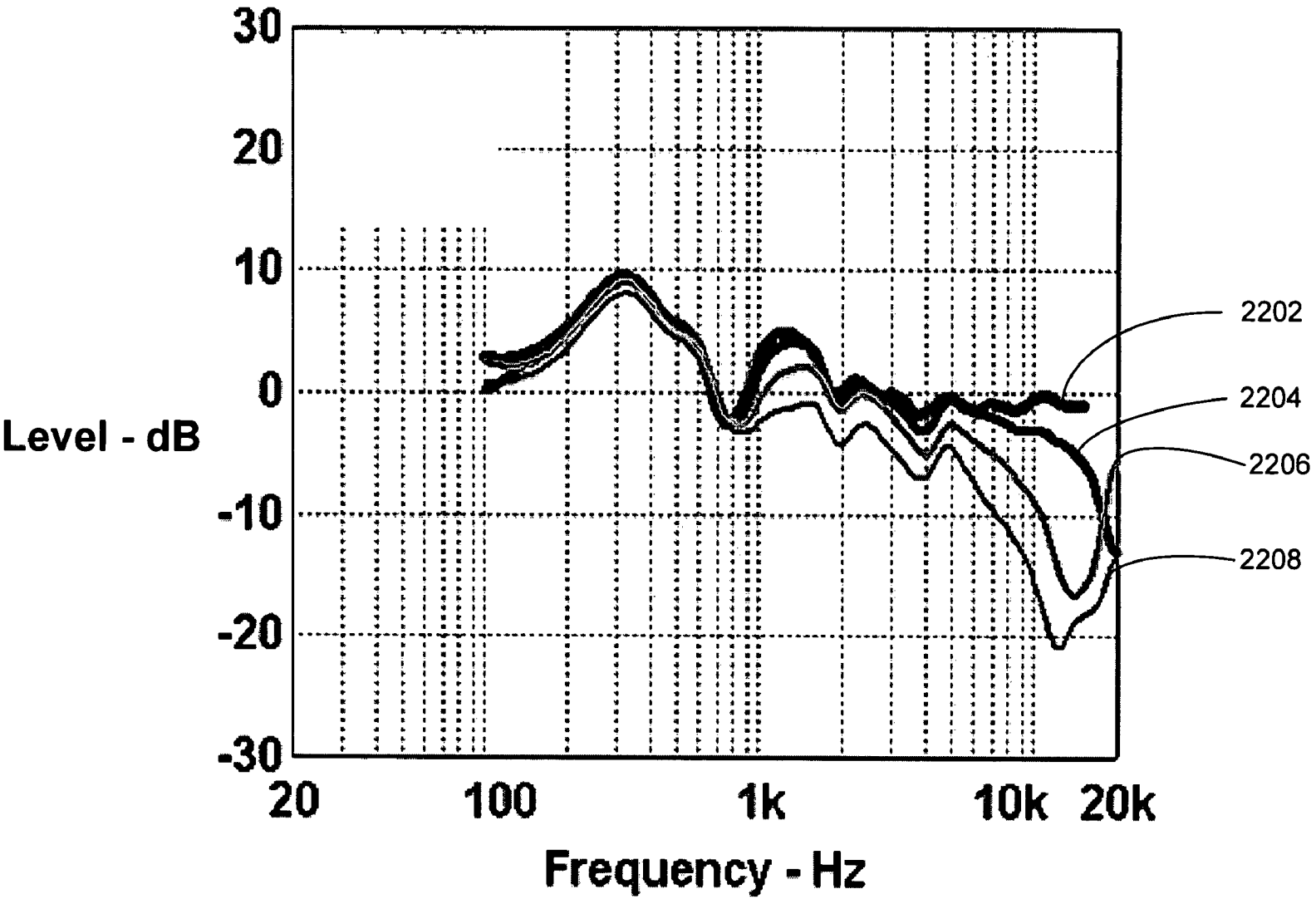
FIG. 22 is a plurality of responses of a straight line array at the sampling point angles depicted in FIG. 11 at a height of zero meters above an acoustically reflective planar surface.
Figure 23:
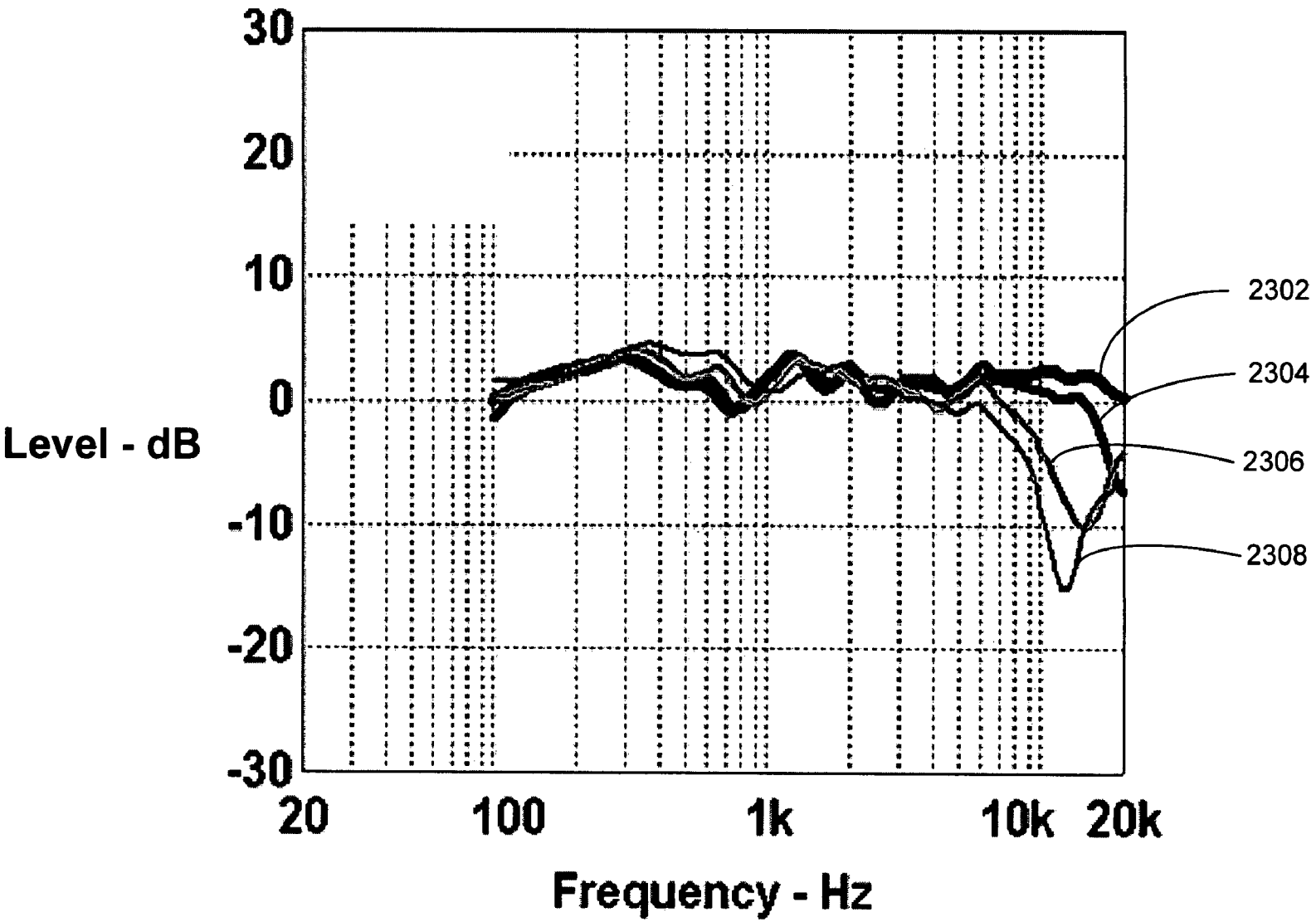
FIG. 23 is a plurality of responses of a reflective loudspeaker array at the sampling point angles depicted in FIG. 11 at a height of zero meters above an acoustically reflective planar surface.

FIGS. 21, 22 and 23 illustrate the variation in frequency response of the compact monitor 1004, the straight line array 1006 and the reflective loudspeaker array 1008, respectively based on samples that were taken at the angles of FIG. 11 at a height of zero meters above the acoustically reflective planar surface 1010. In this example, the samples were actually taken on the surface of the acoustically reflective planar surface 1010. In FIG. 21, with reference to FIG. 11, the frequency responses of the compact monitor 1004 include a first frequency response curve 2102 representing a sample taken at the first sample point 1104, a second frequency response curve 2104 representing a sample taken at the second sample point 1106, a third frequency response curve 2106 representing a sample taken at the third sample point 1108, and a fourth frequency response curve 2108 representing a sample taken at the fourth sample point 1110. The sharp dip in frequency response at about 2.4 kHz is due to a woofer-tweeter interference effect due to the distance below the axis of the compact monitor 1004 at which the samples were taken.

In FIG. 22, with reference to FIG. 11, the frequency responses of the straight line array 1006 include a first frequency response curve 2202 representing a sample taken at the first sample point 1104, a second frequency response curve 2204 representing a sample taken at the second sample point 1106, a third frequency response curve 2206 representing a sample taken at the third sample point 1108, and a fourth frequency response curve 2208 representing a sample taken at the fourth sample point 1110. In FIG. 23, with reference to FIG. 11, the frequency responses of the reflective loudspeaker array 1008 include a first frequency response curve 2302 representing a sample taken at the first sample point 1104, a second frequency response curve 2304 representing a sample taken at the second sample point 1106, a third frequency response curve 2306 representing a sample taken at the third sample point 1108, and a fourth frequency response curve 2308 representing a sample taken at the fourth sample point 1110.

In general, the compact monitor 1004 was significantly detrimentally affected by the interaction with the acoustically reflective planar surface 1010 when compared to the performance of the straight line array 1006 and the reflective loudspeaker array 1008. The detrimental effects, such as comb filtering, created with the acoustically reflective planar surface 1010 decreased as the sample point was moved close to the acoustically reflective planar surface 1010 (FIG. 16 (one meter above) versus FIG. 21 (zero meters above), however, the woofer-tweeter interference effect and a high frequency roll off is present in the responses of FIG. 21.

As illustrated by the relatively flat and relatively parallel frequency response curves of FIGS. 20 and 23, the reflective loudspeaker array 1008 suffers no similar detrimental effect from operating on the acoustically reflective planar surface 1010 since it is designed to cooperatively operate with the acoustically reflective planar surface 1010 as previously discussed. Although the straight line array 1006 provided relatively flat and parallel frequency response curves at one meter above the acoustically reflective planar surface 1010 (FIG. 18), the sampled responses at zero meters above the acoustically reflective planar surface 1010 (FIG. 22), depict an undesirable response when compared to the sampled responses of the reflective loudspeaker array 1008 at the zero meters height. Due to the detrimental effect of changes in height above the acoustically reflective planar surface 1010 of the on-axis and off axis responses of the straight line array 1006, the combination of the reflected and direct sound waves do not result in the performance and operation advantages achieved with the reflective loudspeaker array 1008. As a result, the capability of the straight line array 1006 to constructively combine the direct sound waves and the reflected sound waves to generate an acoustic image that is similar to the acoustic image generated by the reflective loudspeaker array 1008 is significantly less. Accordingly, the straight line array 1006 is unable to generate a mirror image and a resulting composite virtual array that is comparable in acoustic or operational performance to the mirror image reflective loudspeaker array (202 FIG. 2) and the composite virtual array generated with the reflective loudspeaker array 1008. Thus, the desirable effects of increased perceived height of the array, increased sensitivity of the array, an increase in the maximum sound pressure level (SPL) capability, a decrease of near-far variation of sound pressure level (SPL) and an operating bandwidth that may be extended down by at least about an octave are significantly diminished, if not eliminated, in the straight line array 1006.

With regard to response versus distance of the reflective loudspeaker array 1008, in FIG. 19, the level change is only about 10 dB going from very close to the array at 0.1 m out to a distance of 4 m. The responses are quite well behaved, stay uniformly flat, and are fairly uniform with distance. In comparison to the responses in FIG. 17 for the straight line array 1006, the reflective loudspeaker array 1008 has desirably increased uniformity and flatness throughout the frequency range. With regard to the responses in FIGS. 18 and 22 versus the responses in FIGS. 20 and 23, the curves for the straight line array 1006 and the reflective loudspeaker array 1008 are both quite well behaved at one meter above the acoustically reflective planar surface 1010. Due to the curvature of the reflective loudspeaker array 1008, there is some off axis level drop as the angles increase due to the focused and directed nature of the beam produced. However, as previously discussed, the response of the reflective loudspeaker array 1008 is significantly more desirable than the straight line array 1006 at zero meters above the acoustically reflective planar surface 1010.

Figure 24:
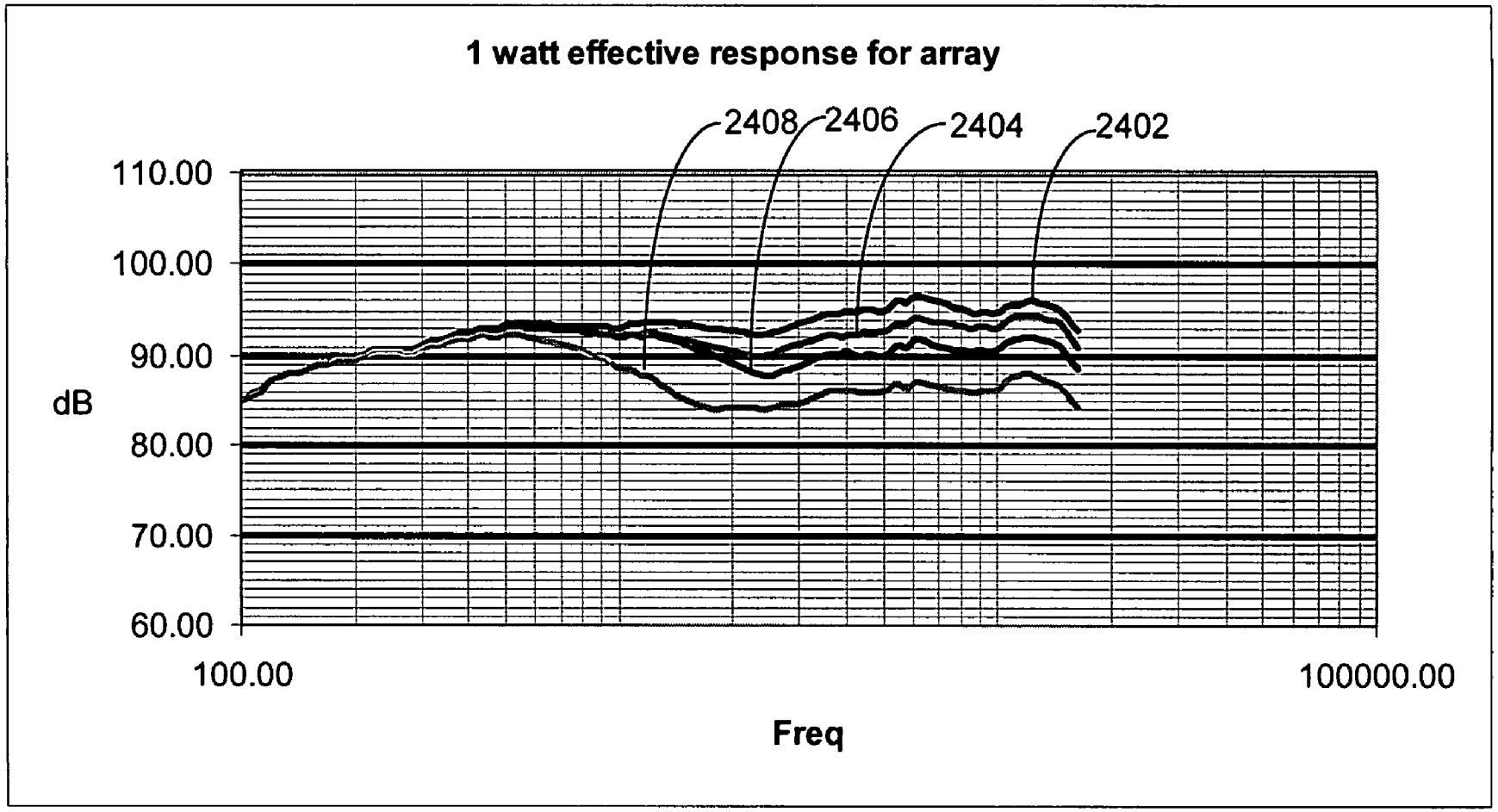
FIG. 24 is a group of frequency response plots for an example configuration of the pair of reflective loudspeaker arrays illustrated in FIG. 9.

Referring again to FIG. 9, in one example of an asymmetrical array, the first reflective loudspeaker array 902 may be articulated to form a constant radius of curvature with an angle of about eight degrees, and the second reflective loudspeaker array 904 may be articulated to form a constant radius of curvature with an angle of about thirty degrees. FIG. 24 is a frequency response diagram representing frequency versus decibels with a 1 watt effective response at a determined distance from such a prototype configuration. In FIG. 24 and with reference to FIG. 9, a first plot 2402 is indicative of a frequency response at a first sample point 906. The first sample point is on a central axis 908 of the combination of the first reflective loudspeaker array 902 and the second reflective loudspeaker array 904. The central axis 908 intersects the contiguously aligned bases of the pair of reflective loudspeaker arrays 902 and 904 at an intersection point 910. A second plot 2404 is indicative of a frequency response measured at a second sample point 912. The second sample point 912 is at an angle of five degrees above the central axis 908 when measured from the intersection point 910, and is at the same distance from the array as the first sample point 906. A third plot 2406 is indicative of a frequency response measured at a third sample point 914. The third sample point 914 is at an angle of twelve degrees below the central axis 908 when measured from the intersection point 910, and is at the same distance from the array as the first sample point 906. A fourth plot 2408 is indicative of a frequency response measured at a fourth sample point 916. The fourth sample point 916 is at an angle of twenty degrees below the central axis 908 when measured from the intersection point 910, and is at the same distance from the array as the first sample point 906. Ideally, each of the response curves are roughly flat and parallel. Thus, the response curves illustrated in FIG. 24 depict a desirable response.

Figure 25:
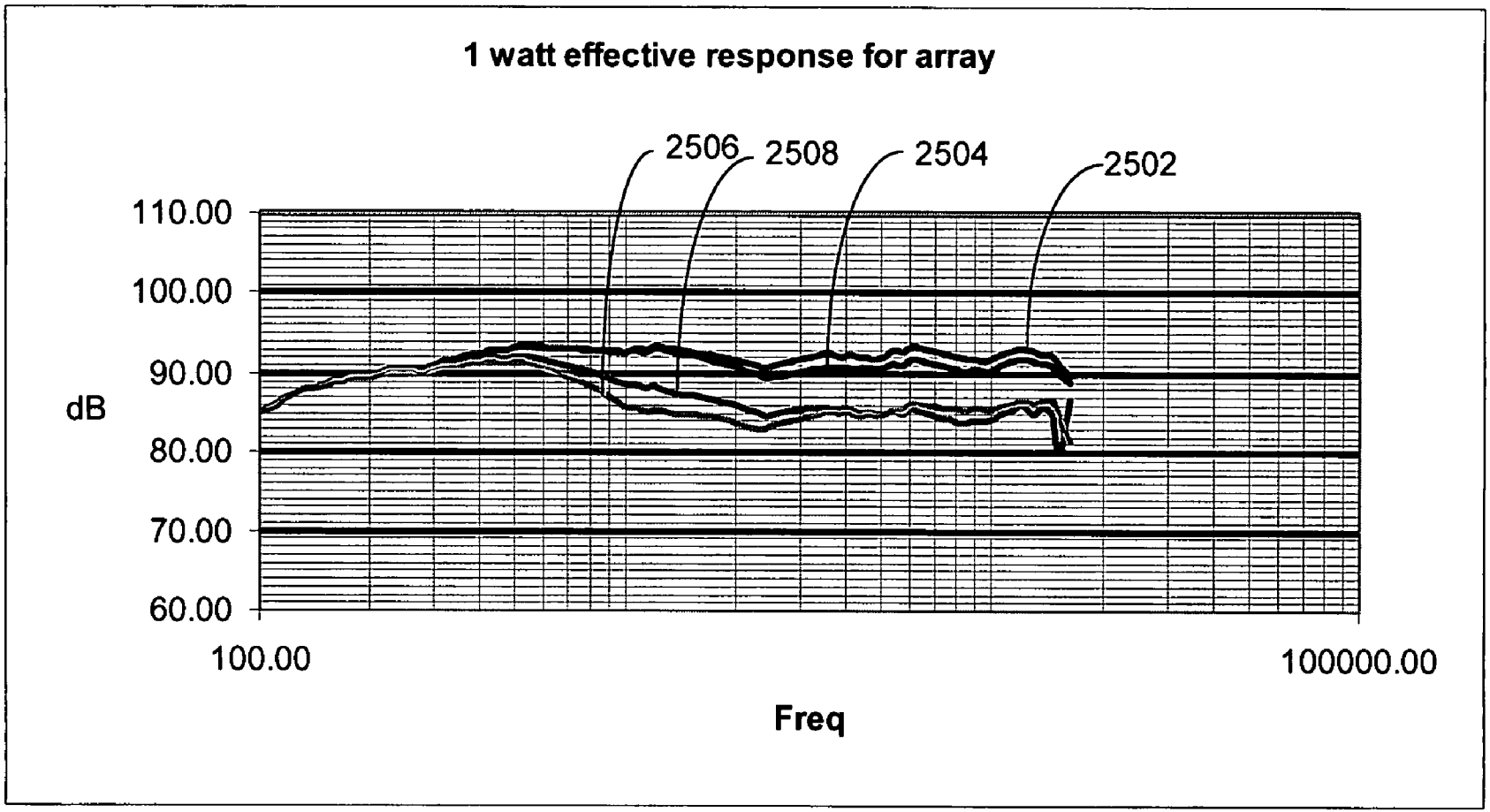
FIG. 25 is another group of frequency response plots for another example configuration of the pair of reflective loudspeaker arrays illustrated in FIG. 9.

In another example asymmetrical array, the first reflective loudspeaker array 902 may be articulated to form a constant radius of curvature with an angle of about nineteen degrees, and the second reflective loudspeaker array 904 may be articulated to form a constant radius of curvature with an angle of about thirty-eight degrees. FIG. 25 is a frequency response diagram representing frequency versus decibels with a 1 watt effective response at a determined distance from such a prototype configuration. In FIG. 25, and with reference to FIG. 9, a first plot 2502 is indicative of a frequency response at the first sample point 906 on the central axis 908. A second plot 2504 is indicative of a frequency response measured at a fifth sample point 918 that is at an angle of seven degrees below the central axis 908 when measured from the intersection point 910, and is at the same distance from the array as the first sample point 906. A third plot 2506 is indicative of a frequency response measured at a sixth sample point 920 that is at an angle of fifteen degrees above the central axis 908 when measured from the intersection point 910, and is at the same distance from the array as the first sample point 906. A fourth plot 2508 is indicative of a frequency response measured at a seventh sample point 922 that is at an angle of twenty-five degrees below the central axis 908 when measured from the intersection point 910, and is at the same distance from the array as the first sample point 906. Again, the response curves illustrated in FIG. 25 depict a desirable response.

A first constant radius of curvature in the first reflective loudspeaker array 902 and a second constant radius of curvature in the second reflective loudspeaker array 904 may be used to express the relationship between the respective angles. As evidenced by FIGS. 24 and 25, maintaining the ratio at or below a determined value may result in a desired frequency response. In one example, the desired ratio of the angle may be maintained at or below a 4:1 ratio. In another example, an angle of the radius of curvature of each of the first and second reflective loudspeaker arrays 902 and 904 is greater than or equal to five degrees.

As previously discussed, the response of an asymmetrical loudspeaker array may be tailored to the listening audience to create asymmetrical coverage patterns. Listening spaces having different physical configurations may be accommodated by adjusting the asymmetrical coverage patterns of the asymmetrical loudspeaker array. Accordingly, by separately directing and focusing the coverage patterns of each of the first and second loudspeaker arrays 902 and 904, undesirable sound energy reflected by surrounding structures in a particular listening space may be minimized.

The previously described examples of the reflective loudspeaker array provide significant advantages in performance due to cooperative operation with an acoustically reflective planar surface. Due to the cooperative operation, detrimental effects of acoustic reflections from an adjacently positioned acoustically reflective surface are minimized. In addition, the acoustically reflective planar surface may provide the mirror image loudspeaker array resulting in a composite virtual array that is acoustically and visually perceived as twice the physical height of the reflective loudspeaker array.

Due to the perceived acoustic doubling of the height, the number of loudspeakers in the reflective loudspeaker array are also perceived to be doubled, thereby increasing the sensitivity and the maximum sound pressure level of the reflective loudspeaker array by 6 dB when compared to a free standing array. The reflective loudspeaker array may also control vertical beamwidth operating frequency down an octave lower when cooperatively operated with an acoustically reflective planar surface due to the effective doubling of the height while the coverage area remains the same. Further, the reflective loudspeaker array may provide a more uniform SPL that minimizes near field and far field variations.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A reflective loudspeaker array comprising:

a frame that includes a curved surface longitudinally extending between a first end and a second end of the frame, where the first end is operable to be positioned near an acoustically reflective planar surface;

at least five loudspeakers adjacently disposed in the frame so that at least a portion of the at least five loudspeakers are disposed in the curved surface, where a sound emitting surface of each of the at least five loudspeakers comprises a frontal plane, each of the at least five loudspeakers configured to receive a respective audio signal;

a first of the at least five loudspeakers disposed nearest the first end of the frame, where the frontal plane of the first of the at least five loudspeakers is positioned substantially perpendicular to the acoustically reflective planar surface when the first end is aligned with the acoustically reflective planar surface;

a second of the at least five loudspeakers disposed proximate the second end of the frame, where the frontal plane of the second of the at least five loudspeakers is non linear with respect to the frontal plane of the first of the at least five loudspeakers, and a magnitude of the respective audio signal received by the first of the at least five loudspeakers is greater than a magnitude of the respective audio signal received by the second of the at least five loudspeakers; and the at least five loudspeakers operable to generate a direct sound wave, a portion of which is reflected with the acoustically reflective planar surface to form a reflected sound wave, and all of the reflected sound wave is constructively combined with the direct sound wave.

2. The reflective loudspeaker array of claim 1, where the at least five loudspeakers are disposed in the frame to be concentric with a common axis.

3. The reflective loudspeaker array of claim 1, where the curved surface is curved with a constant radius of curvature.

4. The reflective loudspeaker array of claim 1, where the first end includes a substantially flat surface that is alignable substantially in parallel with the acoustically reflective planar surface.

5. The reflective loudspeaker array of claim 4, where the substantially flat surface is positionable to be contiguous with the acoustically reflective planar surface.

6. The reflective loudspeaker array of claim 1, where the acoustically reflective planar surface is a substantially flat surface extending a length in a first direction that is at least the length of the frame between the first end and the second end.

7. The reflective loudspeaker array of claim 1, where the frame comprises a first portion that includes a first surface curved at a first constant radius of curvature, and a second portion with a second surface curved with a second constant radius of curvature that is different than the first constant radius of curvature.

8. The reflective loudspeaker array of claim 1, where the frontal plane of the second of the at least five loudspeakers forms an angle with the acoustically reflective planar surface that is less than 90 degrees.

9. A reflective loudspeaker array comprising:

a housing comprising a base that is configured to be positioned adjacent to an acoustically reflective planar surface so that the housing outwardly extends away from the acoustically reflective planar surface in a direction; and at least five loudspeakers disposed adjacently on a surface of the housing, where at least a portion of the surface is curved at a radius of curvature, and where each of the at least five loudspeakers includes a frontal plane that is substantially parallel to at least a portion of the surface of the housing;

where each of the at least five loudspeakers are operable to be driven by a respective audio signal to generate direct sound waves, and part of said direct sound waves are reflected with said acoustically reflective planar surface as reflected sound waves; and where the reflected sound waves are a mirror image of the direct sound waves and are constructively combined with the direct sound waves to produce an acoustic image.

10. The reflective loudspeaker array of claim 9, where the mirror image outwardly extends away from said acoustically reflective planar surface in another direction opposite the direction that the housing extends.

11. The reflective loudspeaker array of claim 9, where the frontal plane of each of a first loudspeaker and a second loudspeaker of the at least five loudspeakers are substantially parallel with respect to each other, and where the frontal plane of each of a third loudspeaker and a fourth loudspeaker of the at least five loudspeakers form an angle greater than five degrees with respect to each other.

12. The reflective loudspeaker array of claim 9, where the base includes a surface that is contiguously alignable in parallel with the acoustically reflective planar surface.

13. The reflective loudspeaker array of claim 9, where the radius of curvature is a constant radius of curvature.

14. The reflective loudspeaker array of claim 9, where the at least five loudspeakers are concentrically aligned on the surface to have a common central axis.

15. The reflective loudspeaker array of claim 9, where the frontal plane of a first of the at least five loudspeakers is positionable nearest the acoustically reflective planar surface and substantially perpendicular thereto.

16. The reflective loudspeaker array of claim 9, where the acoustically reflective planar surface is a substantially flat surface extending away from the base in all directions to one or more distances that are all equal to or greater than a length that the frame extends away from the acoustically reflective planar surface.

17. A reflective loudspeaker array comprising:

a plurality of loudspeakers operable to be driven by a corresponding plurality of audio signals;

a channel on which each of the loudspeakers are mounted such that a first of the loudspeakers is nearest a first end of the channel and a second of the loudspeakers is nearest a second end of the channel; and a base included at the first end, where the base is formed to align the frame substantially perpendicular to a sound reflective planar surface;

where the first loudspeaker is operable to emit a sound wave in response to being driven by a corresponding first audio signal, where a magnitude of the first audio signal is greater than a second audio signal operable to drive the second of the loudspeakers; and where a magnitude of the corresponding audio signals provided to the corresponding loudspeakers sequentially increase in magnitude from the second end toward the first end.

18. The reflective loudspeaker array of claim 17, where a frontal plane of the first of the loudspeakers is aligned to be substantially perpendicular to the planar surface when the base is aligned to be substantially parallel with the planar surface.

19. The reflective loudspeaker array of claim 17, where a first group of the loudspeakers are aligned linearly in a first direction on the frame surface, and a second group of loudspeakers are aligned linearly in a second direction on the frame surface that is perpendicular to the first direction.

20. The reflective loudspeaker array of claim 17, where the frame comprises a plurality of sub frames that are movable coupled to allow movement of the loudspeakers mounted thereon.

21. The reflective loudspeaker array of claim 17, where the frame comprises a plurality of subframes coupled by a plurality of linkages to be pivotally moveable with respect to adjacently coupled subframes, where at least one of the loudspeakers is mounted on each of the subframes.

22. The reflective loudspeaker array of claim 21, where each of the subframes are pivotally moveable with respect to at least two subframes coupled by linkages thereto.

23. A reflective loudspeaker array comprising:

at least five loudspeakers operable to be driven with respective audio signals;

a rigid frame formed with a frame surface that is at least partially curved with a constant radius of curvature, where the rigid frame includes a first end having a substantially flat surface that is alignable in parallel with an acoustically reflective planar surface, and where the frame further includes a second end maintainable in free air spaced away from the acoustically reflective planar surface;

where each of the at least five loudspeakers include an acoustic sound emitting surface that forms a frontal plane; and where the at least five loudspeakers are mounted in the frame surface so that the frontal plane of each of the at least five loudspeakers are substantially parallel with the frame surface; and where a first of the at least five loudspeakers is positioned nearest the first end so that the frontal plane of the first of the at least five loudspeakers is positioned substantially perpendicular with the acoustically reflective planar surface when the flat surface is substantially parallel with the acoustically reflective planar surface; and where another of the at least five loudspeakers is positioned nearest the second end, and a magnitude of the respective audio signals operable to drive the respective loudspeakers is increased from the another of the at least five loudspeakers toward the one of the at least five loudspeakers.

24. A method of generating a sound field with a reflective loudspeaker array, the method comprising:

providing at least five loudspeakers mounted on a surface of a frame having a radius of curvature;

positioning a first end of the frame adjacent a planar surface that is acoustically reflective so that a second end of the frame is positioned away from the planar surface; driving the at least five loudspeakers with respective audio signals to produce direct sound waves;

reflecting a portion of the direct sound waves as reflected sound waves with the planar surface;

constructively combining all of the reflected sound waves with the direct sound waves; and generating an acoustic image representative of the direct sound waves and a mirror image of the direct sound waves.

25. The method of claim 24, where driving the at least five loudspeakers comprises driving a first loudspeaker positioned nearest the planar surface with a first audio signal and driving a second loudspeaker positioned farthest from the planar surface with a second audio signal, where a magnitude of the first audio signal is greater than a magnitude of the second audio signal.

26. The method of claim 24, where positioning a first end of the frame comprises positioning the first end of the frame so that a frontal plane of a first one of the at least five loudspeakers nearest the first end is substantially perpendicular with the planar surface, and a frontal plane of a second of the at least five loudspeakers forms an angle with the planar surface of less than ninety degrees.

27. The method of claim 24, where generating an acoustic image comprises doubling an effective height of the frame.

28. The method of claim 24, where generating an acoustic image comprises doubling a sound pressure output capability of the at least five loudspeakers.

29. The method of claim 24, where generating an acoustic image comprises doubling a sensitivity of the at least five loudspeakers.

30. The method of claim 24, where generating an acoustic image comprises extending a vertical coverage of a frequency bandwidth of the direct sound waves downward by an octave.

31. The method of claim 24, further comprising articulating the frame horizontally to adjust a horizontal coverage pattern of the generated acoustic image.

32. The method of claim 24, further comprising articulating the frame vertically to adjust the angle of curvature and a vertical coverage pattern of the generated acoustic image.

* * * * *